US011464696B2

(12) United States Patent
Glukhovsky et al.

(10) Patent No.: US 11,464,696 B2
(45) Date of Patent: Oct. 11, 2022

(54) METHODS AND APPARATUS FOR BODY WEIGHT SUPPORT SYSTEM

(71) Applicant: Bioness Inc., Valencia, CA (US)

(72) Inventors: Arkady Glukhovsky, Valencia, CA (US); Todd Cushman, Coto de Caza, CA (US); Augustine Smith, Santa Clarita, CA (US)

(73) Assignee: Bioness Inc., Valencia, CA (US)

( * ) Notice: Subject to any disclaimer, the term of this patent is extended or adjusted under 35 U.S.C. 154(b) by 478 days.

(21) Appl. No.: 15/698,184

(22) Filed: Sep. 7, 2017

(65) Prior Publication Data

US 2018/0071159 A1 Mar. 15, 2018

Related U.S. Application Data

(60) Provisional application No. 62/385,485, filed on Sep. 9, 2016.

(51) Int. Cl.
*A61G 7/10* (2006.01)
*A63B 24/00* (2006.01)
(Continued)

(52) U.S. Cl.
CPC ..... *A61G 7/1001* (2013.01); *A61G 7/1015* (2013.01); *A61G 7/1042* (2013.01);
(Continued)

(58) Field of Classification Search
CPC .... A61H 2201/5061; A61H 2201/5071; A61H 2201/5058; A61H 2201/5069;
(Continued)

(56) References Cited

U.S. PATENT DOCUMENTS 764,781 A 7/1904 Sumner
895,055 A 8/1908 Spooner
(Continued)

FOREIGN PATENT DOCUMENTS

CH 669780 A5 4/1989
CN 104308861 B 1/2015
(Continued)

OTHER PUBLICATIONS

Office Action for U.S. Appl. No. 13/745,830, dated Jun. 15, 2015, 9 pages.
(Continued)

*Primary Examiner* — Peter M. Cuomo
*Assistant Examiner* — Morgan J McClure
(74) *Attorney, Agent, or Firm* — Cooley LLP

(57) ABSTRACT

A body weight support system includes a support track, a trolley, and a power rail. The support track has a first portion and a second portion. The trolley has a support assembly and a drive assembly. The support assembly is configured to support at least a portion of a body weight of a user. The drive assembly is configured to movably suspend the trolley from the first portion of the support track when the user moves along a first surface and is configured to movably suspend the trolley from the second portion of the support track when the user moves along a second surface separate from the first surface. The power rail is coupled to the support track and is configured to be in electrical contact with a portion of the trolley as the trolley moves along the first portion and the second portion of the support track.

18 Claims, 13 Drawing Sheets

(51) Int. Cl.

| | |
|---|---|
| ***A63B 21/005*** | (2006.01) |
| ***A63B 21/00*** | (2006.01) |
| ***A63B 69/00*** | (2006.01) |
| ***A61H 3/00*** | (2006.01) |
| ***A63B 21/068*** | (2006.01) |
| ***A63B 71/00*** | (2006.01) |
| ***A63B 71/06*** | (2006.01) |
| ***A63B 22/00*** | (2006.01) |

(52) U.S. Cl.

CPC ..... *A61G 7/1049* (2013.01); *A61G 7/1051* (2013.01); *A61H 3/008* (2013.01); *A63B 21/0058* (2013.01); *A63B 21/00181* (2013.01); *A63B 21/068* (2013.01); *A63B 24/0087* (2013.01); *A63B 69/0064* (2013.01); *A61H 2201/50* (2013.01); *A61H 2201/501* (2013.01); *A61H 2201/5061* (2013.01); *A61H 2201/5064* (2013.01); *A61H 2201/5079* (2013.01); *A61H 2201/5084* (2013.01); *A61H 2201/5092* (2013.01); *A61H 2201/5097* (2013.01); *A63B 21/4001* (2015.10); *A63B 2022/0094* (2013.01); *A63B 2024/0093* (2013.01); *A63B 2071/0063* (2013.01); *A63B 2071/0081* (2013.01); *A63B 2071/0683* (2013.01); *A63B 2220/10* (2013.01); *A63B 2220/30* (2013.01); *A63B 2220/40* (2013.01); *A63B 2220/52* (2013.01); *A63B 2220/802* (2013.01); *A63B 2220/806* (2013.01); *A63B 2225/107* (2013.01); *A63B 2225/20* (2013.01); *A63B 2225/50* (2013.01)

(58) Field of Classification Search

CPC .. A61H 2201/5097; A61H 3/008; A61H 3/00; A61H 2201/5084; A61H 2201/5092; A61H 2201/50; A61H 2201/1652; A61H 2201/1215; A61H 2201/501; A61H 2201/5079; A61H 2201/5064; A61H 2003/001; A61B 5/103; A61B 5/1116; A61B 5/6831; A61B 5/6887; A61G 7/1001; A61G 7/1015; A61G 7/1051; A61G 7/1042; A61G 7/1049; A63B 24/0087; A63B 69/0064; A63B 2071/0063; A63B 2071/0081; A63B 21/0058; A63B 21/00181; A63B 21/068; A63B 21/4001; A63B 2220/30; A63B 2220/802; A63B 2220/0094; A63B 2220/40; A63B 2220/10; A63B 2220/806; A63B 2220/52; A63B 2225/50; A63B 2225/107; A63B 2225/20; A63B 2024/0093

See application file for complete search history.

(56) References Cited

U.S. PATENT DOCUMENTS

| | | | | | |
|---|---|---|---|---|---|
| 1,536,766 | A | | 5/1925 | Cammann | |
| 1,648,930 | A | | 11/1927 | Zouck | |
| 1,971,294 | A | | 8/1934 | Bunker | |
| 2,211,220 | A | * | 8/1940 | Verplanck | B60M 1/14 104/35 |
| 2,360,505 | A | * | 10/1944 | Medenwald | B66C 7/00 191/8 |
| 2,519,165 | A | | 8/1950 | Weise et al. | |
| 2,688,933 | A | | 9/1954 | Spafford | |
| 2,819,755 | A | * | 1/1958 | Berger | A61H 3/008 482/69 |
| 2,871,915 | A | * | 2/1959 | Hogan | A61H 3/008 482/69 |
| 3,424,458 | A | | 1/1969 | Hopps, Jr. | |
| 3,720,172 | A | | 3/1973 | Dehne | |
| 3,780,663 | A | * | 12/1973 | Pettit | A61G 7/1015 104/307 |
| 3,985,082 | A | | 10/1976 | Barac | |
| 4,164,350 | A | * | 8/1979 | Zeijdel | A61H 3/008 482/69 |
| 4,243,147 | A | | 1/1981 | Twitchell et al. | |
| 4,360,307 | A | | 11/1982 | Larsson | |
| 4,372,452 | A | | 2/1983 | McCord | |
| 4,427,398 | A | | 1/1984 | Eisbrecher et al. | |
| 4,445,502 | A | * | 5/1984 | Swan | A61H 3/00 104/62 |
| 4,606,082 | A | | 8/1986 | Kuhlman | |
| 4,627,119 | A | | 12/1986 | Hachey et al. | |
| 4,639,955 | A | | 2/1987 | Carminati et al. | |
| 4,706,782 | A | | 11/1987 | Spoeler et al. | |
| 4,911,426 | A | * | 3/1990 | Scales | A61H 3/008 128/845 |
| 4,944,056 | A | | 7/1990 | Schroeder et al. | |
| 5,048,822 | A | | 9/1991 | Murphy | |
| 5,138,953 | A | | 8/1992 | Horcher et al. | |
| 5,337,908 | A | | 8/1994 | Beck, Jr. | |
| 5,490,293 | A | | 2/1996 | Nilsson | |
| 5,511,486 | A | | 4/1996 | Pollard et al. | |
| 5,626,540 | A | * | 5/1997 | Hall | A61H 1/0229 482/69 |
| 5,632,206 | A | | 5/1997 | Summa et al. | |
| 5,638,755 | A | | 6/1997 | Love et al. | |
| 5,695,432 | A | * | 12/1997 | Soderlund | A63B 69/0064 482/69 |
| 5,809,591 | A | | 9/1998 | Capaldi et al. | |
| 5,850,928 | A | | 12/1998 | Kahlman et al. | |
| 5,904,099 | A | | 5/1999 | Danneker | |
| 5,997,444 | A | * | 12/1999 | McBride | A61H 3/008 482/66 |
| 6,035,465 | A | * | 3/2000 | Rogozinski | A61G 5/02 5/83.1 |
| 6,079,578 | A | * | 6/2000 | Dyson | A61G 7/1015 104/89 |
| 6,080,087 | A | | 6/2000 | Bingham | |
| 6,192,803 | B1 | | 2/2001 | Nishino | |
| 6,315,138 | B1 | | 11/2001 | Dyson | |
| 6,389,618 | B1 | * | 5/2002 | Flynn | A61G 7/1042 5/81.1 R |
| 6,464,208 | B1 | | 10/2002 | Smith | |
| 6,520,484 | B1 | | 2/2003 | Shimizu et al. | |
| 6,645,126 | B1 | | 11/2003 | Martin et al. | |
| 6,679,185 | B2 | | 1/2004 | Sullivan et al. | |
| 6,890,288 | B2 | | 5/2005 | Bingham | |
| 7,137,771 | B2 | | 11/2006 | Maurer et al. | |
| 7,240,621 | B2 | | 7/2007 | Chepurny et al. | |
| 7,291,097 | B1 | * | 11/2007 | Dace | A61H 3/008 482/51 |
| 7,303,049 | B1 | | 12/2007 | Greenlee | |
| 7,377,377 | B2 | | 5/2008 | Christiansson | |
| 7,462,138 | B2 | | 12/2008 | Shetty et al. | |
| 7,618,223 | B1 | | 11/2009 | Begley | |
| 7,883,450 | B2 | * | 2/2011 | Hidler | A61H 3/008 212/104 |
| 7,938,757 | B1 | | 5/2011 | Cockrell | |
| 7,993,248 | B1 | | 8/2011 | Rasmussen | |
| 8,397,320 | B2 | | 3/2013 | Capaldi | |
| 8,584,274 | B2 | | 11/2013 | Hushek | |
| 8,789,682 | B2 | | 7/2014 | Fisher | |
| 8,978,905 | B2 | | 3/2015 | Bergenstrale et al. | |
| 9,510,991 | B2 | * | 12/2016 | Stockmaster | A61H 3/008 |
| 9,682,000 | B2 | | 6/2017 | Glukhovsky | |
| 9,839,569 | B2 | | 12/2017 | Behnke et al. | |
| 9,855,177 | B2 | | 1/2018 | Erturk et al. | |
| 10,219,960 | B2 | | 3/2019 | Behnke et al. | |
| 10,688,316 | B2 | | 6/2020 | Butson et al. | |
| 10,864,393 | B2 | * | 12/2020 | Burke | A62B 35/0081 |
| 2001/0027149 | A1 | | 10/2001 | Bingham | |
| 2003/0084508 | A1 | | 5/2003 | Faucher et al. | |
| 2003/0146069 | A1 | | 8/2003 | Kaiser | |
| 2003/0153438 | A1 | | 8/2003 | Gordon et al. | |
| 2003/0200607 | A1 | | 10/2003 | Faucher et al. | |

(56) References Cited

U.S. PATENT DOCUMENTS

| | | | | |
|---|---|---|---|---|
| 2003/0201374 | A1 | 10/2003 | Faucher et al. | |
| 2004/0074414 | A1 | 4/2004 | Phillips | |
| 2004/0143198 | A1 | 7/2004 | West | |
| 2004/0200795 | A1 | 10/2004 | Summa | |
| 2005/0115914 | A1 | 6/2005 | Chepurny et al. | |
| 2006/0189453 | A1 | 8/2006 | Leblond | |
| 2006/0229167 | A1 | 10/2006 | Kram et al. | |
| 2006/0240952 | A1 | 10/2006 | Schlosser | |
| 2007/0004567 | A1 | 1/2007 | Shetty et al. | |
| 2008/0287268 | A1 | 11/2008 | Hidler | |
| 2009/0308828 | A1 | 12/2009 | Hansen | |
| 2010/0000546 | A1 | 1/2010 | Park | |
| 2010/0312152 | A1 | 12/2010 | Sarkodie-Gyan et al. | |
| 2011/0000015 | A1 | 1/2011 | Faucher et al. | |
| 2011/0072580 | A1 | 3/2011 | Imhoff | |
| 2011/0100249 | A1 | 5/2011 | Ipsen | |
| 2011/0265260 | A1 | 11/2011 | Darrow | |
| 2012/0000876 | A1 | 1/2012 | Bergenstrale et al. | |
| 2012/0018249 | A1 | 1/2012 | Mehr | |
| 2012/0198612 | A1 | 8/2012 | Tindall | |
| 2012/0325586 | A1 | 12/2012 | Meggs et al. | |
| 2014/0201905 | A1 | 7/2014 | Glukhovsky | |
| 2014/0201906 | A1 | 7/2014 | Erturk et al. | |
| 2014/0206503 | A1 | 7/2014 | Stockmaster et al. | |
| 2015/0143627 | A1 | 5/2015 | McBride | |
| 2015/0283921 | A1* | 10/2015 | Zimmerman | B60M 1/12 191/38 |
| 2015/0320632 | A1 | 11/2015 | Vallery et al. | |
| 2016/0256346 | A1 | 9/2016 | Stockmaster et al. | |
| 2017/0128313 | A1 | 5/2017 | Gluhkovsky et al. | |
| 2018/0036196 | A1 | 2/2018 | Behnke et al. | |
| 2019/0216664 | A1 | 7/2019 | Behnke et al. | |
| 2021/0401648 | A1 | 12/2021 | Behnke et al. | |
| 2021/0401649 | A1 | 12/2021 | Behnke et al. | |
| 2022/0016471 | A1 | 1/2022 | McBride et al. | |

FOREIGN PATENT DOCUMENTS

| | | | | |
|---|---|---|---|---|
| DE | 102008015879 | A1 | 4/2009 | |
| EP | 0088061 | A2 | 9/1983 | |
| EP | 0564177 | A1 * | 10/1993 | B66B 9/08 |
| EP | 0564177 | A1 | 10/1993 | |
| EP | 1296595 | B1 | 8/2007 | |
| EP | 2402279 | A1 | 1/2012 | |
| EP | 2730266 | A1 | 5/2014 | |
| JP | S-50-20727 | | 7/1975 | |
| JP | 56-086854 | A | 7/1981 | |
| JP | 58-152784 | A | 9/1983 | |
| JP | H02-131435 | U | 11/1990 | |
| JP | H06-015658 | U | 3/1994 | |
| JP | H08-099792 | A | 4/1996 | |
| JP | 2000-237250 | A | 9/2000 | |
| JP | 2003-047635 | A | 2/2003 | |
| JP | 2003-276593 | A | 10/2003 | |
| JP | 2004-329278 | A | 11/2004 | |
| JP | 2010-063256 | A | 3/2010 | |
| JP | 2017-011924 | A | 1/2017 | |
| WO | WO 2009/104096 | | 8/2009 | |
| WO | WO 2013/117750 | | 8/2013 | |
| WO | WO 2016/126851 | A1 | 8/2016 | |
| WO | WO 2017/083666 | | 5/2017 | |
| WO | WO 2018/152190 | A1 | 8/2018 | |

OTHER PUBLICATIONS

Office Action for U.S. Appl. No. 13/745,830, dated Dec. 17, 2015, 9 pages.
Office Action for U.S. Appl. No. 13/745,830, dated Jun. 2, 2016, 11 pages.
Office Action for U.S. Appl. No. 14/226,021, dated Sep. 14, 2016, 13 pages.
Office Action for U.S. Appl. No. 14/226,021, dated Feb. 22, 2017, 11 pages.
Office Action for U.S. Appl. No. 14/613,140, dated Aug. 28, 2017, 25 pages.
Office Action for U.S. Appl. No. 14/613,140, dated Mar. 26, 2018, 28 pages.
Office Action for U.S. Appl. No. 14/613,140, dated Oct. 30, 2018, 28 pages.
Office Action for U.S. Appl. No. 15/783,755, dated May 7, 2018, 13 pages.
Office Action for U.S. Appl. No. 15/896,731, dated Aug. 8, 2019, 17 pages.
Office Action for U.S. Appl. No. 15/349,390, dated Jan. 17, 2019, 15 pages.
Extended European Search Report for European Application No. 14740676.3, dated Aug. 18, 2016, 6 pages.
European Examination Report for European Application No. 14740676.3, dated Jun. 14, 2019, 5 pages.
Notice of Reasons for Rejection for Japanese Application No. 2015-553851, dated Jul. 4, 2016, 5 pages.
International Search Report and Written Opinion for International Application No. PCT/US2014/012064, dated May 9, 2014.
Notice of Reasons for Rejection for Japanese Application No. 2017-052240, dated Jan. 15, 2018, 9 pages.
Final Notice of Reasons for Rejection for Japanese Application No. 2017-052240, dated Jul. 19, 2018, 4 pages.
Extended European Search Report for European Application No. 16747097.0, dated Jul. 27, 2018, 8 pages.
International Search Report and Written Opinion for International Application No. PCT/US2016/016131, dated Apr. 21, 2016, 10 pages.
International Search Report and Written Opinion for International Application No. PCT/US2017/050482, dated Dec. 21, 2017, 9 pages.
International Search Report and Written Opinion for International Application No. PCT/US2018/018166, dated Jul. 2, 2018, 11 pages.
Extended European Search Report for European Application No. 16865093.5, dated Apr. 2, 2019, 6 pages.
International Search Report and Written Opinion for International Application No. PCT/US2016/061552, dated Jan. 31, 2017, 10 pages.
Vallery, H. et al., "Multidirectional Transparent Support for Overground Gait Training," 2013 IEEE International Conference on Rehabilitation Robotics, Seattle, WA (Jun. 2013), 7 pages.
VAHLE Electrification Systems, "Enclosed Conductor System KBH," Catalogue, 2014, 28 pages.
Canadian Examination Report for Canadian Application No. 2,897,620, dated Feb. 5, 2020, 4 pages.
Extended European Search Report for European Application No. 17849531.3, dated May 4, 2020, 8 pages.
Office Action for U.S. Appl. No. 16/599,793, dated Mar. 16, 2021, 19 pages.
Notice of Reasons for Rejection for Japanese Application No. 2019-508223, dated Apr. 1, 2021, 13 pages.
Extended European Search Report for European Application No. 18753980.4, dated Oct. 29, 2020, 9 pages.
Office Action for U.S. Appl. No. 15/698,184, dated Mar. 12, 2020, 11 pages.
Australian Examination Report for Australian Application No. 2016215484, dated Apr. 23, 2020, 5 pages.
European Office Action for European Application No. 14740676.3, dated Jan. 17, 2022, 6 pages.
Notice of Reasons for Rejection for Japanese Application No. 2017-534701, dated Oct. 16, 2019, 16 pages.
European Office Action for European Application No. 16747097.0, dated Mar. 2, 2020, 8 pages.
Notice of Reasons for Rejection for Japanese Application No. 2019-021357, dated Feb. 26, 2020, 6 pages.
Decision of Rejection for Japanese Application No. 2019-021357, dated Aug. 21, 2020, 6 pages.
Notice of Reasons for Rejection for Japanese Application No. 2020-211145, dated Aug. 3, 2021, 7 pages.
Examination Report for Australian Application No. 2017322238, dated Sep. 20, 2021, 4 pages.

(56) References Cited

OTHER PUBLICATIONS

Notice of Reasons for Rejection for Japanese Application No. 2019-539192, dated Aug. 27, 2021, 11 pages.
Australian Examination Report for Australian Application No. 2016354524, dated Sep. 11, 2020, 4 pages.
European Office Action for European Application No. 16865093.5, dated Jul. 28, 2021, 4 pages.
Decision of Rejection for Japanese Application No. 2018-521405, dated Sep. 16, 2021, 13 pages.
Office Action for U.S. Appl. No. 15/349,390, dated Jan. 17, 2019, 8 pages.

* cited by examiner

METHODS AND APPARATUS FOR BODY WEIGHT SUPPORT SYSTEM

CROSS-REFERENCE TO RELATED APPLICATIONS

This application claims priority to and the benefit of U.S. Provisional Patent Application No. 62/385,485 entitled, "Methods and Apparatus for Body Weight Support System," filed Sep. 9, 2016, the disclosure of which is incorporated herein by reference in its entirety.

BACKGROUND

The embodiments described herein relate to apparatus and methods for supporting the body weight of a patient. More particularly, the embodiments described herein relate to apparatus and methods for supporting the body weight of a patient during gait training and/or gait therapy.

Successfully delivering intensive yet safe gait therapy to individuals with significant walking deficits can present challenges to skilled therapists. In the acute stages of many neurological injuries such as stroke, spinal cord injury, traumatic brain injury, or the like individuals often exhibit highly unstable walking patterns and poor endurance, making it difficult to safely practice gait for both the patient and therapist. Because of this, rehabilitation centers often move over-ground gait training to a treadmill where body-weight support systems can help minimize fall risks while raising the intensity of the training.

While body-weight supported treadmill training promotes gains in walking ability, there are few systems for transitioning patients from training on a treadmill to safe, weight-supported over-ground gait training. Furthermore, since a primary goal of most individuals with walking impairments is to walk in their homes and in their communities rather than on a treadmill, it is often desirable that therapeutic interventions targeting gait involve over-ground gait training (e.g., not on a treadmill).

In some instances, known gait support systems can be configured to provide body-weight support for over-ground gait training; however, such know gait support systems can be limited in one or more ways. For example, in some instances, gait support system is configured to support a patient under static unloading, which can result in abnormal ground reaction forces and altered muscle activation patterns in the lower extremities. In addition, static unloading systems may limit the vertical excursions of a patient that prevent certain forms of balance and postural therapy where a large range of motion is desired. Moreover, some such systems are configured to be adjusted to a desired level of support prior to a training session and are not configured to modulate the amount of body weight support in real time.

In other known systems, the dynamics of a support system can impact the training of the patient. For example, in some known systems, a patient can be supported by a passive trolley and rail system configured to support the patient while the patient physically drags the trolley along the overhead rail during gait therapy. While the trolley may have a relatively small mass, the patient may feel the presence of the mass, which in turn, can lead to patient compensation for the dynamics of the trolley.

In other known systems, a patient can be supported by an active (e.g., motorized) trolley system; however, some such systems can have an inadequate or slow dynamic response and/or can have a limited range of motion (e.g., resulting from an attached power cable bundle or the like). Some known systems are further limited to supporting a patient while the patient follows a predetermined path (e.g., defined by a range of motion of the trolley and/or defined by a track along which the trolley moves), which may limit, for example, a patient's lateral range of motion or the like. Moreover, some know systems are configured to support a patient walking on a substantially flat surface and cannot support the patient, for example, as the patient walks up and/or down stairs and/or otherwise as the patient walks through a change in elevation.

Thus, a need exists for improved apparatus and methods for supporting the body-weight of a patient during gate therapy.

SUMMARY

Apparatus and methods for supporting the body weight of a patient during gait therapy and/or training are described herein. In some embodiments, a body weight support system includes a support track, a trolley, and a power rail. The support track has a first portion and a second portion. The trolley has a support assembly and a drive assembly. The support assembly is configured to support at least a portion of a body weight of a user. The drive assembly is configured to movably suspend the trolley from the first portion of the support track when the user moves along a first surface and is configured to movably suspend the trolley from the second portion of the support track when the user moves along a second surface separate from the first surface. The power rail is coupled to the support track and is configured to be in electrical contact with a portion of the trolley as the trolley moves along the first portion and the second portion of the support track.

DETAILED DESCRIPTION

Figure 1:
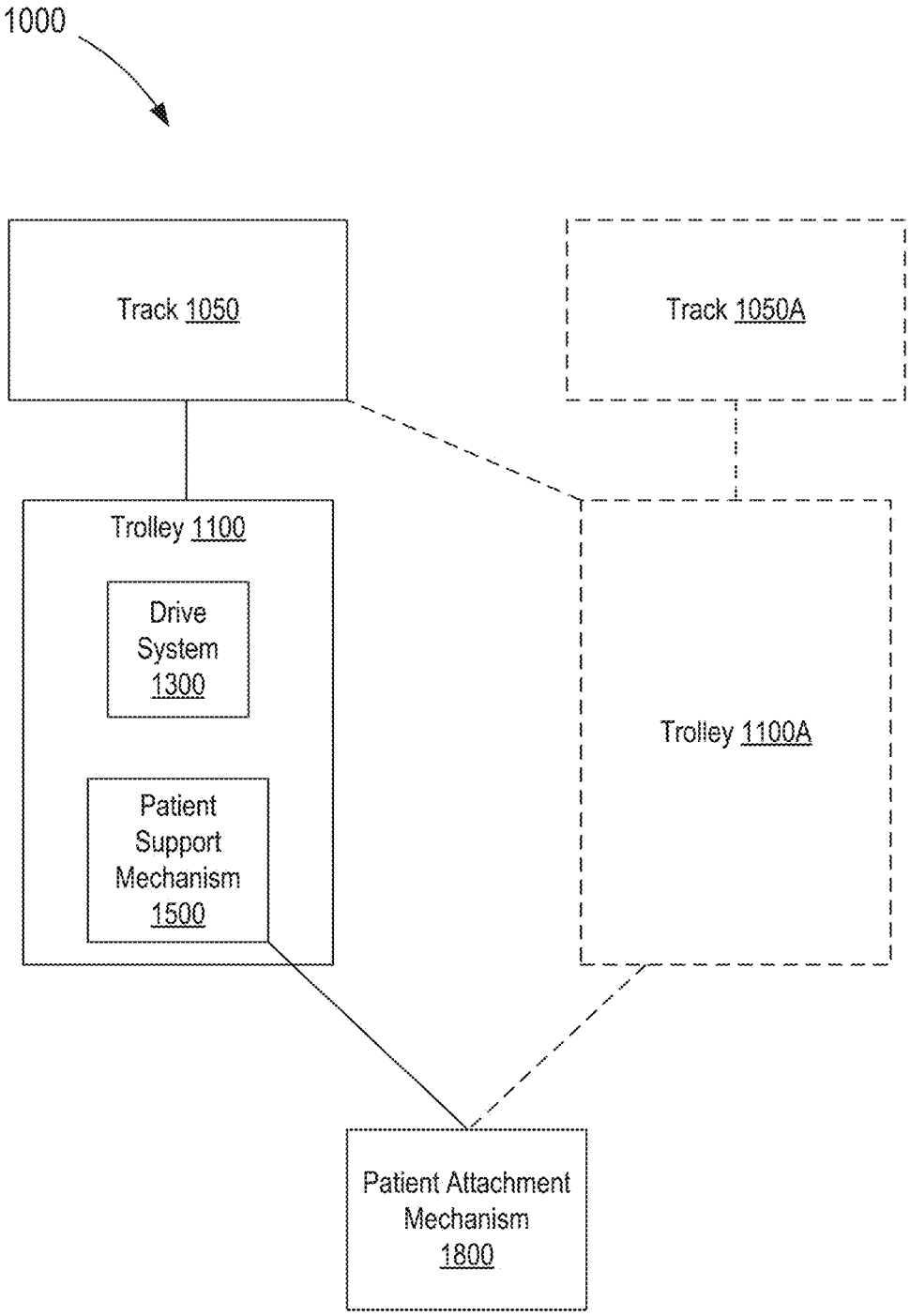
FIG. 1 is a schematic illustration of a body weight support system according to an embodiment.

In some embodiments, a body weight support system includes a support track, a trolley, and a power rail. The support track has a first portion and a second portion. The trolley has a support assembly and a drive assembly. The support assembly is configured to support at least a portion of a body weight of a user. The drive assembly is configured to movably suspend the trolley from the first portion of the support track when the user moves along a first surface and is configured to movably suspend the trolley from the second portion of the support track when the user moves along a second surface separate from the first surface. The power rail is coupled to the support track and is configured to be in electrical contact with a portion of the trolley as the trolley moves along the first portion and the second portion of the support track.

In some embodiments, a body weight support system includes a support track and a trolley. The support track has a first portion, a second portion, and a third portion disposed between the first portion and the second portion. The trolley has a support assembly and a drive assembly. The support assembly is configured to support at least a portion of a body weight of a user. The drive assembly is configured to movably suspend the trolley from the first portion of the support track when the user moves along a first surface and is configured to movably suspend the trolley from the second portion of the support track when the user moves along a second surface separate from the first surface. The drive assembly is configured to movably suspend the trolley from the third portion of the support track as the user moves between the first surface and the second surface.

In some embodiments, a body weight support system includes at least a trolley and a support track. The trolley has a support assembly configured to support at least a portion of a body weight of a user and a drive assembly configured to movably suspend the trolley from the support track. In some embodiments, a method of using the body weight support system includes advancing the trolley along a first portion of the support track in response to the user moving along a first surface and a predetermined portion of the body weight of the user is supported as the user moves along the first surface. The trolley is advanced along a second portion of the support track in response to the user moving along a second surface separate from the first surface and the predetermined portion of the body weight of the user is supported as the user moves along the second surface. The support assembly is adjusted after advancing the trolley along the first portion of the support track and prior to advancing the trolley along the second portion of the support track. The support assembly being adjusted (1) in response to the trolley being suspended from a third portion of the support track disposed between the first portion and the second portion and (2) such that the support assembly supports the predetermined portion of the body weight of the user.

In some embodiments, a body weight support system includes at least one trolley, at least one track, and a patient attachment mechanism. At least one trolley includes a drive system and a patient support system. The drive system is movably coupled to the track and is configured to move along the track in at least a first direction and a second direction. The patient support mechanism is at least temporarily coupled to the patient attachment mechanism such that the trolley(s) support(s) at least a portion of the body weight of the patient as the patient moves in at least the first direction and the second direction.

As used in this specification, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the term "set" can refer to multiple features or a singular feature with multiple parts. For example, when referring to set of walls, the set of walls can be considered as one wall with multiple portions, or the set of walls can be considered as multiple, distinct walls. Thus, a monolithically constructed item can include a set of walls. Such a set of walls may include multiple portions that are either continuous or discontinuous from each other. For example, a monolithically constructed wall can include multiple portions that can be said to form a set of walls. A set of walls can also be fabricated from multiple items that are produced separately and are later joined together (e.g., via a weld, an adhesive, or any suitable method).

As used herein, the term "parallel" generally describes a relationship between two geometric constructions (e.g., two lines, two planes, a line and a plane or the like) in which the two geometric constructions are substantially non-intersecting as they extend substantially to infinity. For example, as used herein, a line is said to be parallel to another line when the lines do not intersect as they extend to infinity. Similarly, when a planar surface (i.e., a two-dimensional surface) is said to be parallel to a line, every point along the line is spaced apart from the nearest portion of the surface by a substantially equal distance. Two geometric constructions are described herein as being "parallel" or "substantially parallel" to each other when they are nominally parallel to each other, such as for example, when they are parallel to each other within a tolerance. Such tolerances can include, for example, manufacturing tolerances, measurement tolerances, and/or the like.

FIG. 1 is a schematic illustration of a body weight support system 1000 according to an embodiment. The body weight support system 1000 (also referred to herein as "support system") can be any suitable system. For example, in some embodiments, the support system 1000 can be substantially similar to or the same as any of those described in U.S. Patent Publication No. 2015/0143627 (referred to henceforth as the "'627 publication") entitled, "Methods and Apparatus for Body Weight Support System," filed Feb. 3, 2015, the disclosure of which is incorporated herein by reference in its entirety. The support system 1000 can be used, for example, in intensive gait therapy and/or training, for example, to support patients with walking deficiencies brought on by neurological injuries such as stroke, spinal cord injury, traumatic brain injury, or the like. In such instances, the support system 1000 can be used to support at least a portion of the patient's body weight to facilitate the gait therapy and/or training. In other instances, the support system 1000 can be used to simulate, for example, low gravity scenarios for the training of astronauts or the like. In still other instances, the support system 1000 can be used to facilitate gait training for any suitable user. As used herein, the term "user" generally refers to a person utilizing the support system 1000 (e.g., whose weight is being at least partially supported) and can include a patient and/or person with a disability, a patient and/or person without a disability, and/or a person undergoing a simulation and/or training.

In some embodiments, the support system 1000 can be used to support a user over a treadmill or stairs instead of or in addition to supporting a user over and across level ground. In other embodiments, the support system 1000 can be used to support a user while traversing and/or otherwise walking along unleveled ground, elevation changes, stairs, etc.

The body weight support system 1000 (also referred to herein as "support system") includes at least a support track

1050, a trolley 1100, and a patient attachment mechanism 1800 (also referred to herein as "attachment mechanism"). The trolley 1100 included in the support system 1000 can be any suitable shape, size, or configuration and can include one or more systems, mechanisms, assemblies, or subassemblies (not shown in FIG. 1) that can perform any suitable function associated with, for example, supporting at least a portion of the body weight of a user. As shown, the trolley 1100 can include at least a drive system 1300 and a patient support mechanism 1500. The drive system 1300 is movably coupled to the support track 1050 (also referred to herein as "track") and configured to move (e.g., slide, roll, or otherwise advance) along a length of the track 1050. In other words, the drive system 1300 is configured to movably suspend the trolley 1100 from the track 1050.

The track 1050 can be any suitable shape, size, or configuration. For example, in some embodiments, the track 1050 can be substantially linear or non-linear. In other embodiments, the track 1050 can be a closed loop such as, for example, circular, oval, oblong, rectangular (e.g., with or without rounded corners), or any other suitable shape. In some embodiments, the track 1050 can be a beam (e.g., an I-beam or the like) included in and/or coupled to a roof or ceiling structure from which at least a portion of the trolley 1100 can "hang" (e.g., at least a portion of the trolley 1100 can extend away from the beam). In other embodiments, at least one end portion of the track 1050 can be coupled to a vertical wall or the like. In still other embodiments, the track 1050 can be included in a free-standing structure such as, for example, a gantry or an A-frame. In some embodiments, the track 1050 can be arranged such that the trolley 1100 moves along a substantially flat surface of the track 1050 with a substantially fixed vertical position. That is to say, the track 1050 can have a slope that is substantially equal to zero and/or a change in elevation of each portion of the track 1050 is substantially equal to zero.

In other embodiments, the track 1050 can have a slope that is greater than zero and/or can otherwise define a change in elevation. For example, at least a portion of the track 1050 can define a decline (and/or an incline) wherein a first end portion of the track 1050 is disposed at a first height and a second end portion of the track 1050 is disposed at a second height, different from the first height. In such embodiments, the trolley 1100 can be hung from a surface of the track 1050 that is parallel to a longitudinal centerline (not shown) of the trolley 1100. In such embodiments, the trolley can be used to support a user moving across an inclined/declined surface, up or down stairs, etc., as described in further detail herein.

In some embodiments, the trolley 1100 can have or define a relatively small profile (e.g., height) such that the space between a surface of the trolley 1100 and a portion of the user can be sufficiently large to allow the user to move between a seated position and a standing position such as, for example, when a user rises out of a wheelchair. In some embodiments, the trolley 1100 can be motorized. For example, in some embodiments, the trolley 1100 can include one or more motors configured to power (e.g., drive, rotate, spin, engage, activate, etc.) the drive system 1300 and/or the patient support mechanism 1500.

The drive system 1300 of the trolley 1100 can include one or more wheels configured to roll along a surface of the track 1050 such that the weight of the trolley 1100 and a portion of the weight of a user utilizing the support system 1000 (e.g., the user is temporarily coupled to the trolley 1100 via the patient attachment mechanism 1800, as described in further detail herein) are supported by the track 1050. Similarly stated, one or more wheels of the drive system 1300 can be disposed adjacent to and on top of a horizontal surface of the track 1050; thus, the trolley 1100 can be "hung" from or suspended from the track 1050. In other embodiments, the surface from which the trolley 1100 is hung need not be horizontal (e.g., can have a nonzero slope, as described above). Furthermore, with the trolley 1100 being hung from the track 1050, the weight of the trolley 1100 and the weight of the user utilizing the support system can increase the friction (e.g., traction) between the one or more wheels of the drive system and the surface of the track 1050 from which the trolley 1100 is hung. Thus, the one or more wheels of the drive system 1300 can roll along the surface of the track 1050 without substantially slipping.

As described above, in some embodiments, the trolley 1100 can be motorized. In such embodiments, the motor(s) can be configured to rotate the wheels of the drive system 1300 at any suitable rate and/or any suitable direction (e.g., forward or reverse) such that the trolley 1100 can pace a user utilizing the support system 1000, as described in further detail herein. In some embodiments, the drive system 1300 (e.g., the motor(s) of the drive system 1300 can be controlled via an electronic system and/or controller included in the trolley 1100 and/or otherwise in communication with the trolley 1100. In some embodiments, the motor(s) can include a clutch, a brake, or the like configured to substantially lock the motor(s) in response to a power failure or the like.

While the drive system 1300 is described above as including one or more wheels (e.g., a set of wheels), in some embodiments, the drive system 1300 can also include a drive gear, sprocket, pinion, etc. configured to selective engage a portion of the track 1050. For example, in some embodiments, the track 1050 can include one or more portions having a slope greater than zero. That is to say, the track 1050 can include one or more portions that forms an incline or decline. In other embodiments, the track 1050 can include one or more portions that is substantially vertical. Such inclined, declined, and/or vertical portions of the track 1050 can include a rack or set of teeth, ribs, protrusions, etc. As such, the trolley 1100 can be moved along the track 1050 (e.g., by the wheels of the drive system 1300) to a position at which the drive gear (or the like) of the drive system 1300 engages the rack of the track 1050. Furthermore, the drive system 1300 can be configured such that the motor(s) rotate the drive gear with the wheels and thus, with the drive gear engaged with the rack, the motor can rotate the drive gear and the wheels to advance the trolley 1100 along the sloped portion of the track 1050. More specifically, the arrangement of the drive gear and the rack is such that the trolley 1100 can be advanced along an inclined, declined, and/or vertical portion of the track 1050 without slippage that can otherwise occur when relying on a friction force between the wheels and the surface of the track 1050. In some embodiments, the drive gear can be configured to rotate freely as the trolley 1100 is moved along a portion of the track 1050 having a zero slope (e.g., a horizontal portion). For example, in some embodiments, the track 1050 does not include a rack along a horizontal portion of the track 1050 and as such, the wheels move the trolley 1100 along the horizontal portion of the track 1050 while the drive gear freely rotates without engaging the track 1050. In other embodiments, the horizontal portion of the track 1050 can include a rack (or set of teeth, protrusions, ribs, and/or the like) that is engaged by the drive gear as the trolley 1100 is moved along the horizontal portion of the track 1050.

The patient support mechanism 1500 (also referred to herein as "support mechanism") can be any suitable configuration and is at least temporarily and/or removably coupled to the attachment mechanism 1800. For example, in some embodiments, the support mechanism 1500 can include a tether that can be temporarily coupled to a coupling portion of the attachment mechanism 1800. The attachment mechanism 1800 can further include a patient coupling portion (not shown in FIG. 1) configured to receive a portion of a harness or the like worn by or coupled to the user. Thus, the attachment mechanism 1800 and the support mechanism 1500 can support a portion of the body weight of a user and temporarily couple the user to the trolley 1100. That is to say, a portion of the tether can extend from the trolley 1100 to couple the patient attachment mechanism 1800 (and a patient/user attached thereto) to the trolley 1100.

In some embodiments, an end portion of the tether can be coupled to, for example, a winch. In such embodiments, the winch can include a motor that can rotate a drum to coil or uncoil the tether. Similarly stated, the tether can be wrapped around the drum and the motor can rotate the drum in a first direction to wrap more of the tether around the drum and can rotate the drum in a second direction, opposite the first direction, to unwrap more of the tether from around the drum. As such, the patient support mechanism 1500 and/or at least the motor of the winch can be a vertical drive system configured to move an end of the tether attached to the patient attachment mechanism 1800 from a first position having a first elevation to a second position having a second elevation different from the first elevation. The horizontal drive system/motor that moves the trolley 1100 along the track 1050 and the vertical drive system that controls the tether can be simultaneously controlled and operated or independently controlled and operated. For example, when a user is walking over a treadmill, there is little or no horizontal movement, but the vertical (weight bearing) drive system is operational to compensate for the changes during the gait, falls, etc.

In some embodiments, the support mechanism 1500 can include one or more pulleys that can engage the tether such that the support mechanism 1500 gains a mechanical advantage (e.g., a reduction in force). In some embodiments, the pulley system can include at least one pulley that is configured to move (e.g., pivot, translate, swing, or the like). In some instances, the pulley can be moved according to a change in force exerted (e.g., by the user) on the tether such that the tension within the tether is substantially unchanged. In some embodiments, the pulley can be operably coupled to a cam, sensor, detector, encoder, and/or the like configured to determine an amount of movement associated with the pulley and thus, one or more characteristics associated with the force applied by the user. In some instances, an electronic system and/or controller can send a signal to the motor included in the winch associated with coiling or uncoiling the tether around the drum in accordance with the movement of the pulley, thereby supporting at least a portion of the user's body weight, as described in further detail herein. By actively supporting the portion of the body weight of the user, the support system 1000 can limit the likelihood and/or the magnitude of a fall of the user supported by the support system 1000. Similarly stated, the support mechanism 1500 and the drive system 1300 of the trolley 1100 can respond to a change in force exerted on the tether, a position of the tether or user, and/or any other suitable change in operating condition in a relatively short amount of time (e.g., much less than a second) to actively limit the magnitude of the fall of the user.

Although not shown in FIG. 1, the trolley 1100 can include an electronic system and/or control system configured to control at least a portion of the trolley 1100. The electronic system can include at least a processor and a memory. The memory can be, for example, a random access memory (RAM), a memory buffer, a hard drive, a read-only memory (ROM), an erasable programmable read-only memory (EPROM), and/or the like. In some embodiments, the memory stores instructions to cause the processor to execute modules, processes, and/or functions associated with controlling one or more mechanical and/or electrical systems included in the patient support system, as described above. The processor can be, for example, a general purpose processor (GPP), a central processing unit (CPU), an accelerated processing unit (APU), and/or the like. The processor can be configured to run or execute a set of instructions or code stored in the memory associated with controlling one or more mechanical and/or electrical systems included in the drive system 1300, the patient support mechanism 1500, and/or any other portion of the trolley 1100. For example, the processor can run or execute a set of instructions or code associated with controlling one or more motors, sensors, communication devices, encoders, or the like, as described above. More specifically, the processor can be configured to execute a set of instructions associated with a feedback loop (e.g., based on a proportional-integral-derivative (PID) control method) wherein the electronic system and/or control system can control the subsequent action of the drive system 1300 and/or the support mechanism 1500 based at least in part on current and/or previous data (e.g., position, velocity, force, acceleration, angle of the tether, or the like) received from the drive system 1300 and/or the support mechanism 1500, as described in further detail herein.

In some embodiments, the trolley 1100 can be battery powered. In other embodiments, the trolley 1100 is operatively coupled to a power rail or conductor configured to provide electrical power to the trolley 1100 (e.g., the electronic system and/or control system, the one or more motor(s), etc.). The power rail or conductor is further coupled to the power source that is configured to provide a flow of electrical current (e.g., electrical power) thereto. The trolley 1100 can include a conductive member configured to be in electric communication with the power rail or conductor. In some embodiments, the power rail can extend substantially parallel to and/or can have a shape substantially similar to the track 1050. In this manner, the trolley 1100 can advance along a length of the track 1050 while remaining in electrical contact with the power rail and/or conductor. Furthermore, the arrangement of the power rail and/or conductor and the trolley 1100 is such that movement of the trolley 1100 along the length of the track 1050 is not hindered or limited by a bundle of cables, as described above with reference to known support systems. Similarly, the movement of the trolley 1100 through a range of elevation changes is not hindered or limited by a bundle of cables and/or any other portion of an electrical system. Moreover, in some embodiments, the power rail can provide electronic communication with one or more electronic device(s) via, for example, broadband over powerlines (BPL) or the like. In some embodiments, the power rail can be at least partially integrated with the track 1050.

In some embodiments, electric power and/or energy can be transferred from the power rail (or one or more portions of the power rail) to the trolley 1100 via any suitable mode of transfer. For example, in some embodiments, a conductive member of the trolley 1100 can be in physical and/or electrical contact with a conductor or conductive portion of the power rail. In other embodiments, the trolley 1100 can include one or more induction coils along which a flow of electric current is induced in response to an alternating electromagnetic field generated by or along at least a portion the power rail and/or the track 1050. In such embodiments, electric power received via induction can be used to provide electric power for the trolley 1100 and/or can be used to, for example, charge one or more batteries of the trolley 1100.

While a single trolley 1100 is described above as being suspended from the track 1050, in some embodiments, more than one trolley can be coupled to and/or suspended from the same track 1050. In such embodiments, the trolleys 1100 hung from the track 1050 can include, for example, proximity sensors configured to sense and/or determine proximity of one or more trolleys relative to that specific trolley, which in turn, can limit and/or substantially prevent collisions or the like.

In other embodiments, the support system 1000 can include multiple tracks and trolleys. For example, in some embodiments, a support system 1000 can include the track 1050 (e.g., a first track 1050) configured to support the trolley 1100 (e.g., a first trolley 1100) and can include a second track 1050A configured to support a second trolley 1100A. In such embodiments, the first track 1050 and the second track 1050A can be substantially similar and the first trolley 1100 and the second trolley 1100A can be substantially similar. In some instances, the first trolley 1100 and the second trolley 1100A each can be operably coupled to the same user (e.g., via a patient support mechanism and the patient attachment mechanism 1800). In this manner, the first trolley 1100 and the second trolley 1100A collectively support at least a portion of a user's body weight. Moreover, by supporting the user with the first trolley 1100 and the second trolley 1100A, the support system 1000 can be configured to determine an amount of lateral movement of the user (e.g., in a direction nonparallel to the track 1050 or 1050A). In such instances, the change in operating condition of the drive system 1300 and/or patient support mechanism 1500 of the first trolley 1100 and/or the change in operating condition of the drive system and/or the patient support mechanism (not shown) of the second trolley 1100A collectively can produce a reaction force on the patient attachment mechanism 1800 that allows for the lateral movement of the user while maintaining a desired amount of body weight support.

In some instances, a user using the support system 1000 may fall in a lateral direction while walking along a predetermined path and in response, each of the first trolley 1100 and the second trolley 1100A can dynamically adjust its drive system and/or patient support mechanism to support, balance, and/or react to a change in force exerted on its tether (e.g., due to the shifting weight of the user during the lateral fall). In some instances, comparing responses of the first trolley 1100 and the second trolley 1100A, for example, can allow for a determination of one or more characteristics associated with the change in force exerted on the tethers (e.g., one or more characteristics associated with the fall). Thus, two or more trolleys 1100 can be suspended from one or more tracks 1050 to provide body weight support in any suitable direction.

Figure 2:
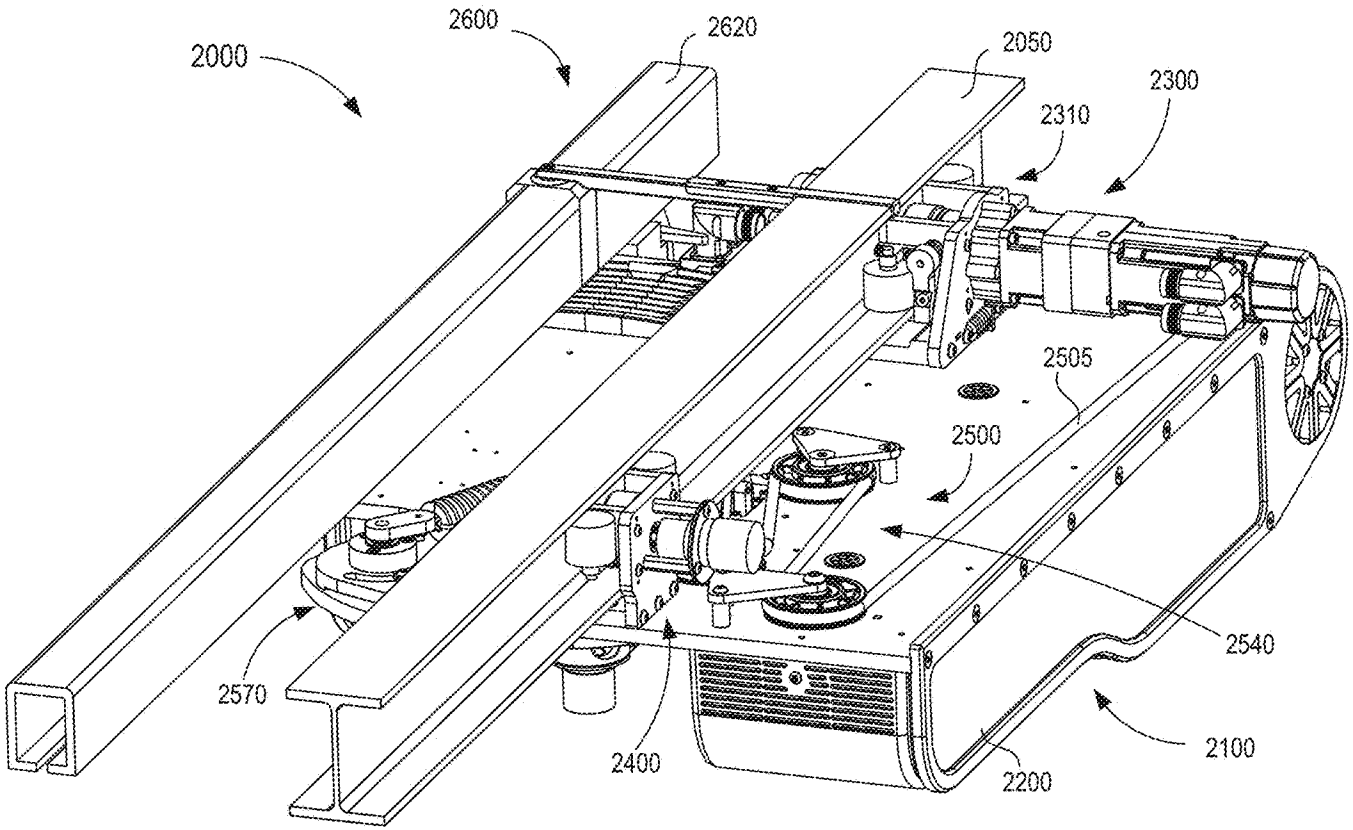
FIGS. 2 and 3 are a front perspective view and a rear perspective view, respectively, of a body weight support system according to an embodiment.
Figure 3:
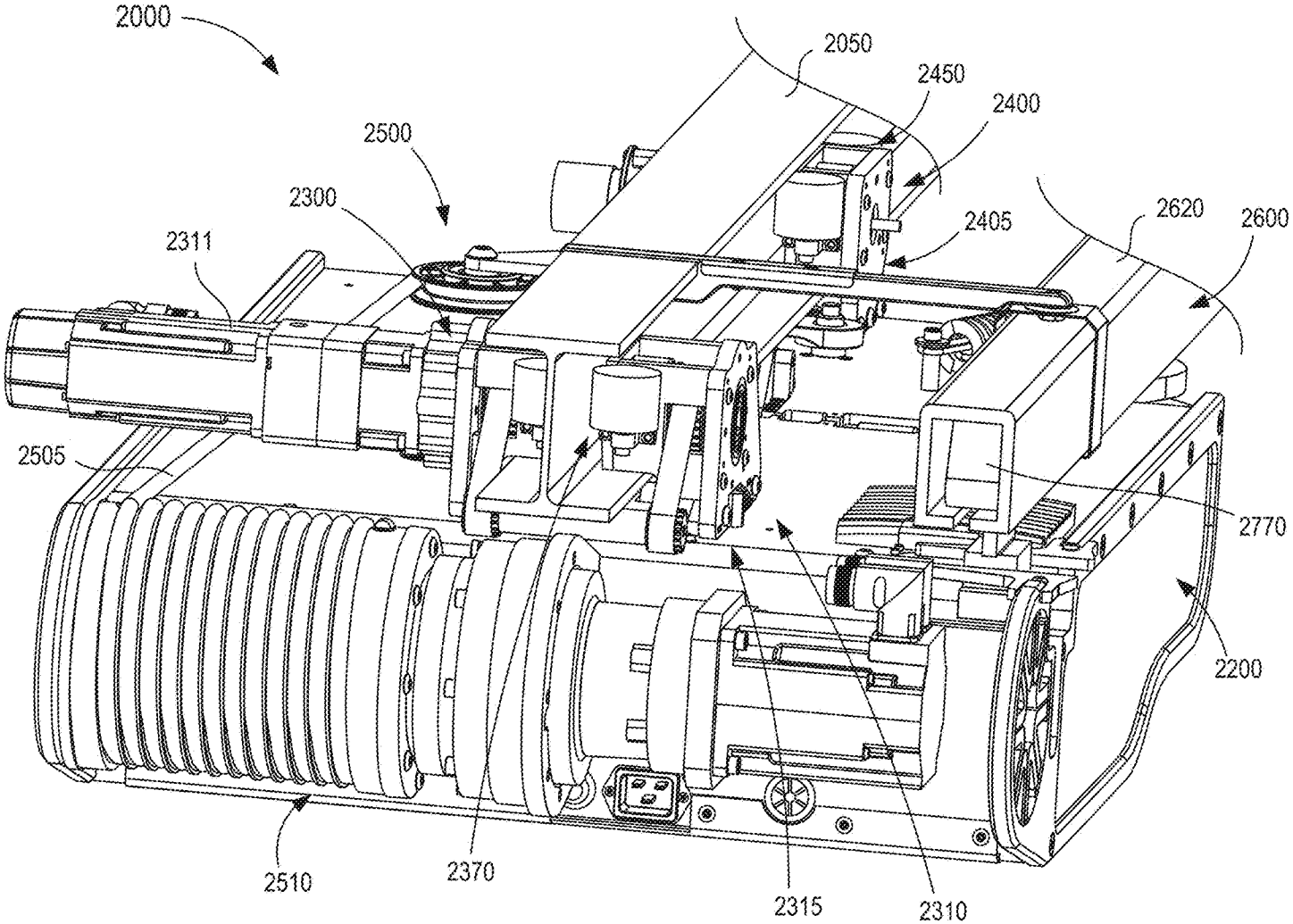
Figure 4:
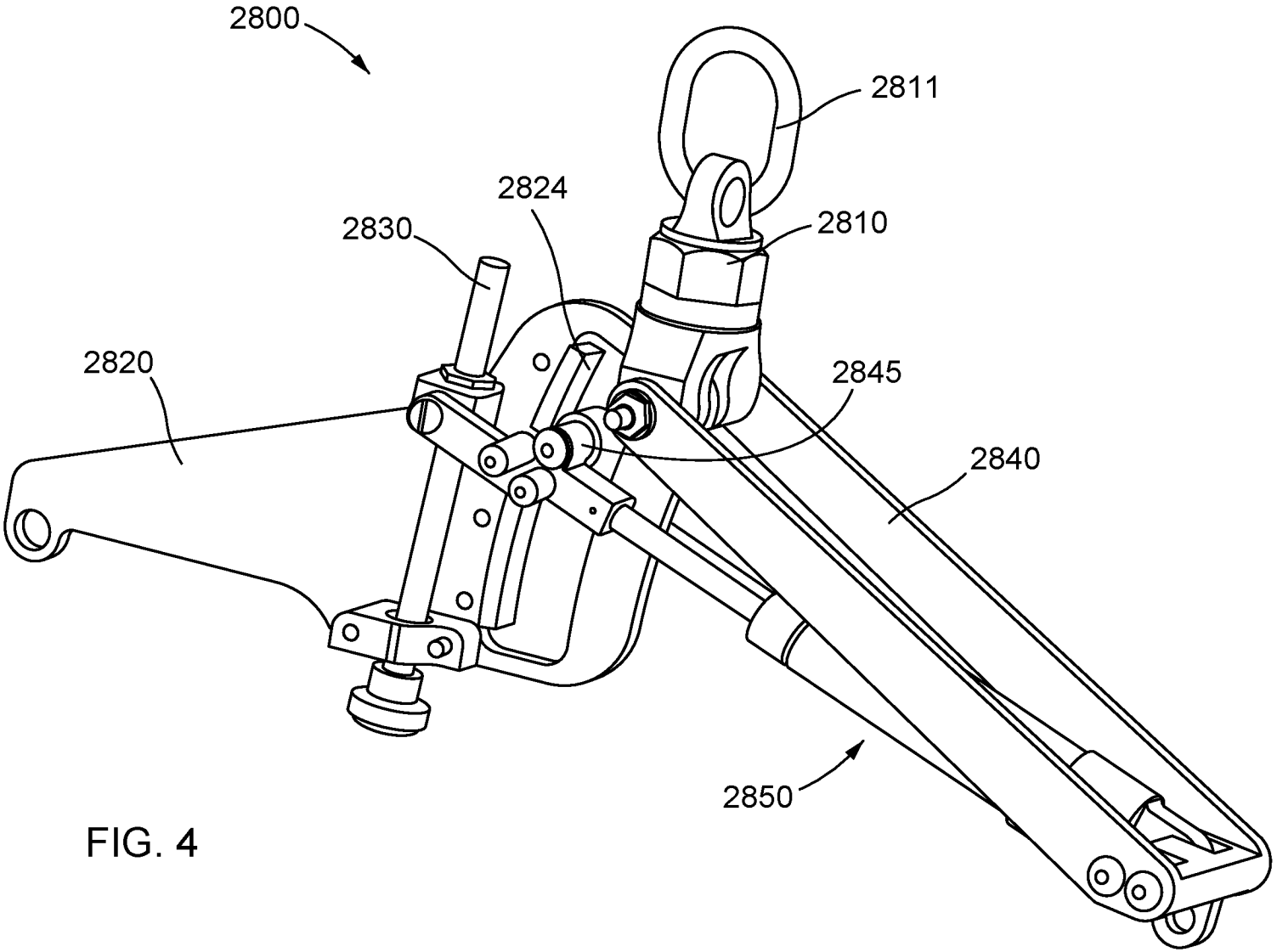
FIG. 4 is a perspective view of a patient attachment mechanism according to an embodiment.

FIGS. 2-4 illustrate a body weight support system 2000 according to an embodiment. The body weight support system 2000 (also referred to herein as "support system") can be used to support a portion of a user's body weight, for example, during gait therapy or the like. The support system 2000 can be any suitable system. For example, in some embodiments, the support system 2000 can be substantially similar to or the same as any of those described in the '627 publication incorporated by reference above. The support system 2000 can be used, for example, in intensive gait therapy and/or training, for example, to support patients with walking deficiencies brought on by neurological injuries such as stroke, spinal cord injury, traumatic brain injury, or the like. In other instances, the support system 2000 can be used to simulate, for example, low gravity scenarios for the training of astronauts or the like. In some embodiments, the support system 2000 can be used to support a patient/user walking on a treadmill, walking up or down stairs, walking up an incline or down a decline, and/or walking on level ground.

The support system 2000 includes a track 2050, a trolley 2100, a power system 2600, and a patient attachment mechanism 2800 (see e.g., FIG. 4). As shown in FIGS. 2 and 3, the trolley 2100 is movably coupled to the support track 2050, which is configured to support the weight of the trolley 2100 and at least a portion of the weight of the user utilizing the support system 2000. In this embodiment, the support track 2050 is shown as having an I-shaped cross-section. In other words, the support track 2050 is, for example, an I-beam. While the support track 2050 is shown in FIGS. 2 and 3 as being substantially linear and having a relatively planar surface along which the trolley 2100 can move, in other embodiments, the support track 2050 can be any suitable shape with variations in a horizontal and/or vertical direction, as described in further detail herein. Moreover, while the support track 2050 is shown as having relatively smooth surfaces along which the trolley 2100 moves (e.g., a surface on which one or more wheels roll), in other embodiments, the support track 2050 can include a rack, tabs, protrusions, teeth, etc. that can be selectively engaged by a portion of the trolley 2100, as described in further detail herein.

As described in further detail herein, the power system 2600 can include a power rail 2620 that extends substantially parallel to the support track 2050 and is at least electrically coupled to the trolley 2100 to transfer a flow of electrical current from a power source (not shown in FIGS. 2-4) to the trolley 2100. In the embodiment shown in FIGS. 2-4, the power rail 2620 is a substantially hollow tube that has one or more conductive inner surface. Moreover, the power rail 2620 defines a channel that is configured to receive a portion of the trolley 2100. As such, the hollow power rail 2620 can receive, for example, a conductive portion of the trolley 2100, thereby placing the trolley 2100 in electric and/or electronic communication with the conductive inner surface(s) power rail 2620. While the power rail 2620 is shown and described as being a substantially hollow tube, in other embodiments, a power rail can be any suitable configuration. For example, in some embodiments, a power rail can be one or more conductive portions on any suitable surface such as a surface of a relative flat or open power rail. In some embodiments, the power rail can be one or more conductive portions of, for example, the support track 2050 (e.g., one or more of inner surface and/or one or more outer surface). As described in further detail herein, a conductive portion of the trolley 2100 can be in electric contact with the power rail 2620 and/or any other suitable conductive surface providing a flow of electric power, which in turn, powers one or more portions of the trolley 2100.

The trolley 2100 can be any suitable shape, size, or configuration. For example, the trolley 2100 can be suspended from the support track 2050 (as described in further detail herein) and can have or define a relatively small profile (e.g., height) such that the space between the trolley 2100 and a user can be maximized. In this manner, the support system 2000 can be used to support users of varying heights, to support a user rising from a sitting position to a standing position as is common in assisting a patient at least partially relegated to a wheelchair, to support a patient/user walking on a set of stairs and/or an inclined or declined surface, and/or the like.

As shown in FIGS. 2 and 3, the trolley 2100 includes a housing 2200 (enclosing an electronic system, not shown), a drive system 2300, and a patient support mechanism 2500. The housing 2200 can be any suitable housing configured to enclose or house one or more portions of the trolley 2100. In some embodiments, for example, the housing 2200 can be substantially similar to the housing described in the '627 publication. More specifically, the housing 2200 can include at least a base, to which one or more portions of the trolley 2100 can be coupled, and a cover configured to enclose one or more portions of the trolley 2100. For example, the drive system 2300, the patient support mechanism 2500, and an electronics system (not shown) can be coupled to the base and the cover can enclose and/or house, for example, at least the electronics system and/or any other suitable portion.

While not shown in FIGS. 2 and 3, the electronic system disposed within the housing 2200 can perform and/or execute a set of instructions or code associated with operating the trolley 2100 and/or can send and receive signals associated with operating the trolley 2100. For example, the electronic system can include at least a processor, a memory, and a communication device. The memory can be, for example, a memory buffer, a hard drive, a RAM, a ROM, an EPROM, and/or the like. In some embodiments, the memory stores instructions to cause the processor to execute modules, processes, and/or functions associated with controlling one or more mechanical and/or electrical systems included in the patient support system 2000. For example, the memory can store instructions, information, and/or data associated with a proportion-integral-derivative (PID) control system. In some embodiments, the PID control system can be included in, for example, a software package. In some embodiments, the PID control can be a set of user controlled instructions executed by the processor that allow the user to "tune" the PID control, as described in detail in the '627 publication.

The processor can be any suitable processing device configured to run or execute a set of instructions or code. For example, the processor can be a GPP, CPU, APU, an application specific integrated circuit (ASIC), a field programmable array, and/or the like. The processor can be configured to run or execute a set of instructions, code stored, for example, in the memory associated with controlling one or more mechanical and/or electrical systems included in a patient support system. For example, the processor can run or execute a set of instructions or code associated with the PID control stored in the memory and further associated with controlling with a portion of the drive system 2300 and/or the patient support mechanism 2500. More specifically, the processor can execute a set of instructions in response to receiving a signal from one or more sensors and/or encoders (shown and described below) that can control one or more subsequent actions of the drive system 2300 and/or the support mechanism 2500. Similarly stated, the processor can execute a set of instructions associated with a feedback loop that includes one or more sensors, encoders, load cells, transducers, and/or the like that send a signal that is at least partially associated with current and/or previous data (e.g., position, velocity, force, acceleration, or the like) received from the drive system 2300 and/or the support mechanism 2500, as described in further detail herein.

The communication device can be, for example, one or more network interface devices (e.g., network cards) configured to communicate with an electronic device over a wired or wireless network. For example, in some embodiments, the communication device can be in wired or wireless communication with one or more sensors, encoders, load cells, transducers, and/or electric or electronic devices included in the trolley 2100. In some embodiments, a user can manipulate a remote control device that sends one or more signals to and/or receives one or more signals from the electronic system associated with the operation of the trolley 2100. For example, in some embodiments, the remote control can be an electronic device that includes at least a processor and a memory and that runs, for example, a personal computer application, a mobile application, a web page, and/or the like. In this manner, a user can engage the remote control to establish a set of system parameters associated with the support system 2000 such as, for example, the desired amount of body weight supported by the support system 2000.

As described above, the trolley 2100 is configured to receive electric power and/or electronic signals from the power rail 2620. For example, the trolley 2100 and/or the electronic system of the trolley 2100 includes a collector 2770 (FIG. 3) that is coupled to a portion of the housing 2200 and that is placed in physical and/or electrical contact with the power rail 2620. The collector 2770 can be any suitable shape, size, or configuration and can be formed from any suitable conductive material, such as, for example, iron, steel, copper, gold, silver, and/or the like. In this manner, the collector 2770 can receive a flow of electrical current from the power rail 2620. While shown as being a substantially solid member, in other embodiments, the collector 2770 can be one or more conductive wheels or the like configured to move (e.g., roll) along the conductive surface of the power rail 2620. In some embodiments, for example, the power rail 2620 can be integrated with and/or otherwise formed by at least a portion of the support track 2050 (e.g., at least one conductive surface of the support track 2050) and the collected can be integrated with and/or otherwise formed by or on one or more wheels of the drive system 2300. In this manner, the collector 2770 establishes electrical and/or electronic contact with the power rail 2620 and in turn, delivers electric power from the power rail 2620 to the trolley 2100 (e.g., the electronic system and/or other portion).

As shown in FIGS. 2 and 3, the drive system 2300 includes a first drive assembly 2310 and a second drive assembly 2400. The drive system 2300 is coupled to the base of the housing 2200 and arranged such that the first drive assembly 2310 and the second drive assembly 2400 are aligned (e.g., coaxial). In this manner, the first drive assembly 2310 and the second drive assembly 2400 can receive a portion of the support track 2050, as described in further detail herein. In some embodiments, the drive system 2300 can be substantially similar to the drive system described in the '627 publication. Therefore, portions of the drive system 2300 are not described in detail herein.

The first drive assembly 2310 includes a motor 2311 configured to drive one or more wheel subassemblies 2370. The motor 2311 is coupled to a support structure, is mechanically connected to the one or more wheel subassembly 2370, and is in electrical communication with a portion of the electronic system. As such, the motor 2311 receives an activation signal (e.g., a flow of electrical current) from the electronic system to cause the motor 2311 to rotate a set of wheels included in the wheel subassembly

2370. As shown in FIGS. 2 and 3, at least a portion of the first drive assembly 2310 is substantially symmetrical about a longitudinal plane (not shown) defined by the first drive assembly 2310. In this manner, each side of the first drive assembly 2310 includes similar components, thereby increasing versatility and decreasing manufacturing costs. That is to say, the first drive assembly 2310 can be substantially symmetrical such that a portion of the first drive assembly 2310 disposed on a first side of the track 2050 is substantially similar to a portion of the first drive assembly 2310 disposed on a second side of the track 2050.

The first drive assembly 2310 can include any suitable support structure 2315 and/or the like configured to couple to and/or support the motor 2311 and the wheel subassembly 2370. For example, the support structure 2315 can include one or more plates, members, walls, etc. configured to provide a support framework or the like to which the motor 2311 and wheel subassembly 2370 are coupled. The support structure 2315 is also coupled to the base of the housing 2200. Thus, the support structure 2315 is operable in coupling the motor 2311 and the wheel subassembly 2370 to the base of the housing 2200.

The wheel subassembly 2370 can include and number of wheels. For example, the wheel subassembly 2370 shown in FIGS. 2 and 3 includes eight wheels each of which is configured to engage and/or move along a surface of the track 2050. In this embodiment, two of the eight wheels are operably coupled to the motor 2311 and/or at least an output of the motor 2311 via one or more bearings, gears, belts, chains, drive shafts, etc. As such, the two wheels can be, for example, active drive wheels or the like, while the remaining wheels can be, for example, passive wheels, guide wheels, and/or otherwise non-driven wheels. In other embodiments, any or all of the wheels included in the wheel subassembly 2370 can be operably coupled to the motor 2311 and/or at least an output of the motor 2311. As such, the wheels of the wheel subassembly 2370 can be configured to roll along one or more surfaces of the track 2050 to move the trolley 2100 along the track 2050.

Although not shown in FIGS. 2 and 3, the first drive assembly 2310 can include and/or can be operably coupled to one or more encoders, sensors, measuring/metering devices, and/or the like. The one or more encoders or the like can be configured to sense, detect, and/or otherwise provide an indication associated with an operating condition of any suitable portion of the first drive assembly 2310. For example, in some embodiments, the encoder(s) or the like can be configured to sense and/or determine a rotational velocity, a rotational acceleration, a torque, and/or the like of one or more wheels and/or an output of the motor 2311. Moreover, the encoder(s) can be in communication with the electronic system and can send signals thereto associated with the operating condition of the motor 2311 and/or any other suitable portion of the first drive assembly 2310. In this manner, the electronic system can receive the signals from the encoder(s) and can perform any suitable process and/or can execute any suitable module associated with controlling at least a portion of the first drive assembly 2310, as described in detail in the '627 publication.

As described above, in some embodiments, the first drive assembly 2370 can be substantially similar in form and/or function to the first drive assembly included in the trolley described in the '627 publication. While not explicitly described above, the first drive assembly 2310 can include any suitable element and/or feature of the first drive assembly described in the '627 publication. In this manner, the electronic system (not shown) can send one or more signals to the motor 2311 operable in activating and/or providing power to the motor 2311. In response, the motor 2311 can rotate an output shaft or the like, which in turn, rotates at least some of the wheels in the wheel subassembly 2370 along the track 2050.

The second drive assembly 2400 can function similarly to the first drive assembly 2310, thus, some portions of the second drive assembly 2400 are not described in further detail herein. The second drive assembly 2400 includes a support structure 2405 configured to support a wheel subassembly 2450. As shown, at least a portion of the second drive assembly 2400 is substantially symmetrical about a longitudinal plane (not shown) defined by the second drive assembly 2400. In this manner, each side of the second drive assembly 2400 includes similar components, thereby increasing versatility and decreasing manufacturing costs, as described above with reference to the first drive assembly 2310.

The support structure 2405 can include any suitable plate, member, wall, etc. configured to provide a support framework or the like to which the wheel subassembly 2450 is coupled. Moreover, the support structure 2405 is coupled to the base of the housing 2200, which in turn, couples the second drive assembly 2400 to the housing 2200.

The wheel subassembly 2450 can be any suitable configuration. For example, in the embodiment shown in FIGS. 2 and 3, the wheel subassembly 2450 includes six wheels, each of which is configured to roll along a surface of the track 2050. The wheels of the wheel subassembly 2450 can be disposed in and/or can have any suitable arrangement. For example, while the first drive assembly 2310 is described above as including the motor 2311 configured to active control and/or rotate one or more wheels, the wheels of the second drive assembly 2400 can be passive (e.g., not operably coupled to a motor or the like). In other words, the wheels included in the wheel subassembly 2450 can each be passive and can move and/or roll along a surface of the track 2050 in response to a rotation of one or more wheels included in the first drive assembly 2310 (e.g., resulting from the motor 2311 rotating the one or more wheels included in the first drive assembly 2310. In this manner, while some components and/or features of the second drive assembly 2400 are not explicitly described in detail herein, the second drive assembly 2400 can include any suitable component and/or feature such as those described in the second drive assembly in the '627 publication.

The support mechanism 2500 of the trolley 2100 includes a tether 2505, a winch assembly 2510, a guide system 2540, and a cam mechanism 2570. The tether 2505 can be, for example, a rope or other long flexible member that can be formed from any suitable material such as nylon or other suitable polymer. The tether 2505 includes a first end portion that is coupled to a portion of the winch assembly 2510 and a second end portion (opposite the first end portion) that can be coupled to any suitable patient attachment mechanism such as, for example, the patient attachment mechanism 2800. Thus, the tether 2505 is configured to engage a portion of the winch assembly 2510, the guide system 2540, and the cam mechanism 2570 to actively support at least a portion of the body weight of a user, as described in further detail herein.

The winch assembly 2510 is coupled to the housing 2200 and is in electrical and/or electronic communication with the electronic system (not shown). The winch assembly 2510 includes a motor that is operably coupled to a drum or the like about which at least a portion of the tether 2505 (e.g., the first end portion of the tether 2505) is coupled. In this manner, the motor can receive, for example, an activation signal (e.g., a flow of electrical current) from the electronic system to cause the motor to rotate the drum in a first rotational direction or in a second rotational direction, opposite the first rotational direction, which in turn, coils or uncoils a portion of the tether 2505 about the drum.

The guide system 2540 of the support mechanism 2500 is coupled to the housing 2200 and is configured to engage the tether 2505 to guide the tether 2505 as it moves in response to a force exerted on, for example, the patient attachment mechanism 2800. The guide system 2540 can include any suitable component and/or feature. For example, in some embodiments, the guide system 2540 can include any number of pulleys, gears, mechanisms, guide members, mounting structures, support structures, etc. In some embodiments, the guide system 2540 can include a set of pulleys or gears configured to provide and/or otherwise arranged to produce a mechanical advantage (e.g., arranged as block and tackle). Such an arrangement can, for example, reduce a torque otherwise used to rotate the drum of the winch assembly 2510 in response to a force applied on the patient attachment mechanism 2800, as described, for example, in the '627 publication.

The cam mechanism 2570 can include any suitable member, mechanism, and/or assembly. For example, as described in the '627 publication, the cam mechanism 2570 can include a cam, a cam arm, and a bias member. Although not shown in FIGS. 2 and 3, the cam of the cam mechanism 2570 can be coupled to a pulley or gear included in the guide system 2540 such that rotation of the pulley results in rotation of the cam. The arrangement of the cam mechanism 2570 can be such that when the cam is rotated in response to a rotation of the pulley (e.g., as a result of a force exerted on the tether 2505), the bias member can exert a force on the cam arm that is operable in resisting the rotation of the cam. As described in detail in the '627 publication, in some instances, relatively small changes in the force exerted on the tether 2505 may not be sufficiently large to rotate the cam, which in turn, can reduce undesirable changes in the amount of body weight supported by the support system 2000 in response to minor fluctuations of force exerted on the tether 2505.

Although not shown in FIGS. 2 and 3, the patient support mechanism 2500 can include and/or can be operably coupled to one or more encoders, sensors, measuring/metering devices, and/or the like. The one or more encoders or the like can be configured to sense, detect, and/or otherwise provide an indication associated with an operating condition of any suitable portion of the patient support mechanism 2500. For example, in some embodiments, the encoder(s) or the like can be configured to sense and/or determine a rotational velocity, a rotational acceleration, a torque, and/or the like of the winch assembly 2510, the guide system 2540, and/or the cam mechanism 2570. Moreover, the encoder(s) can be in communication with the electronic system and can send signals thereto associated with the operating condition of the patient support mechanism 2500. In this manner, the electronic system can receive the signals from the encoder(s) and can perform any suitable process and/or can execute any suitable module associated with controlling at least a portion of the patient support mechanism 2500, as described in detail in the '627 publication.

FIG. 4 illustrates the patient attachment mechanism 2800. Although not shown, the patient attachment mechanism 2800 can be coupled to a harness or the like, worn by the user, to couple the user to the support system 2000, as described below. The patient attachment mechanism 2800 has a first coupling portion 2810, a first arm 2820, and a second arm 2840. The first coupling portion 2810 includes a coupling mechanism 2811 configured to couple to the second end portion of the tether 2505. The first arm 2820 of the patient attachment mechanism 2800 defines a slot 2824 configured to receive a portion of the second arm 2840 to movably couple the second arm 2840 thereto. The first arm 2820 is also coupled to a guide rod 2830 configured to guide and/or at least partially control movement of the second arm 2840 relative to the first arm 2820. The second arm 2840 includes and/or is coupled to one or more energy storage members 2850 (e.g., in the embodiment shown in FIG. 4, the second arm 2840 is coupled to two energy storage members 2850). The energy storage members 2850 can be, for example, gas struts or the like. As shown, the energy storage members 2850 extend toward the first arm 2820 and each include an end portion coupled to and/or otherwise including an engagement member 2845. The engagement member 2845 is movably disposed within the slot 2824 defined by the first arm 2820. In addition, the end portion of the energy storage members 2850 are at least indirectly coupled to the guide rod 2830.

The arrangement of the first arm 2820, the second arm 2840, the guide rod 2830, and the energy storage members 2850 can allow for relative movement between the first arm 2820 and the second arm 2840 in response to a force exerted by the user coupled thereto (e.g., via a harness or the like not shown in FIG. 4). More specifically, when a force is exerted on the first arm 2820 and the second arm 2840 by the user (e.g., coupled thereto via a harness or the like, not shown in FIG. 4), the first arm 2820 and the second arm 2840 pivot relative to and/or towards one another. The pivoting of the first arm 2820 and the second arm 2840 moves the engagement member 2845 within the slot 2824 and further moves the energy storage members 2850 from a configuration of lower potential energy to a configuration of higher potential energy (e.g., compresses a gas strut). Thus, the energy storage members 2850 can absorb at least a portion of a force exerted of the patient attachment mechanism 2800. Moreover, when the force exerted on the patient attachment mechanism 2800 is less than the potential energy of the energy storage members 2850 in the second configuration, the energy storage members 2850 can move towards their first position to pivot the first arm 2820 and the second arm 2840 away from one another. In this manner, the patient attachment mechanism 2800 can be substantially similar in form and function to the patient attachment mechanism described in detail in the '627 publication. In other embodiments, the patient support system 2000 can be used with any suitable patient attachment mechanism or means for coupling an end portion of the tether 2505 to a harness or other article worn by the patient.

As described above, the patient support system 2000 can be substantially similar in form and function to any of the patient support systems described in detail in the '627 publication. Therefore, in use, the patient support system 2000 can actively support at least a portion of the body weight of a user that is coupled thereto. For example, in some instances, a user is coupled to the patient attachment mechanism 2800 which, in turn, is coupled to the second end portion of the tether 2505. In this manner, the support system 2000 (e.g., the tether 2505, the trolley 2100, and the support rail 2050) can support at least a portion of the body weight of the user.

In some instances, a user (e.g., a technician, a therapist, a doctor, a physician, or the like) can input a set of system parameters associated with the user and the support system

2000 (e.g., via a control panel included in or on the trolley 2100 and/or via a remote control device such as a personal computer, mobile device, smart phone, laptop, tablet, hand-held remote, etc.). The system parameters can include, for example, the body weight of the user, the height of the user, a desired amount of body weight to be supported by the support system 2000, a desired speed of the user walking during gait therapy, a desired path or distance along the length of the support track 2050, or the like.

The trolley 2100 can move along the support track 2050 in response to the movement of the user. Similarly stated, the trolley 2100 can move along the support track 2050 as the user walks. In some instances, the trolley 2100 can be configured to remain substantially over-head of the user. In such instances, the electronic system can execute a set of instructions associated with controlling the drive system 2300 and/or the patient support mechanism 2500 based on information received from, for example, one or more encoders, sensors, measuring/metering devices, and/or the like of the drive system 2300 and/or the patient support mechanism 2500, as described in detail in the '627 publication. For example, based on determining the changes in the drive system 2300 and/or support mechanism 2500, the electronic system can send a signal to the motor 2311 of the first drive assembly 2310 and/or the motor of the winch assembly 2510 to change the current state of the drive system 2300 and/or the patient support mechanism 2500, respectively. In some instances, the magnitude of change in the state of the drive system 2300 and/or the patient support mechanism 2500 is based at least in part on a PID control. In such instances, the electronic system (e.g., the processor or any other electronic device in communication with the processor) can determine the changes of the support mechanism 2500 and model the changes based on the PID control. Based on the result of the modeling the electronic system can determine the suitable magnitude of change in the drive system 2300 and/or the patient support mechanism 2500. In this manner, one or more of the electronic devices included in the electronic system, including but not limited to the processor, can execute a set of instructions stored in the memory associated with feedback control of any suitable portion of the trolley 2100 based on information, data, and/or operating status of patient support system 2000. Thus, the support system 2000 shown in FIGS. 2-4 can be used to actively reduce the amount a user falls after stumbling or falling for other reasons, as described in detail in the '627 publication.

Figure 5:
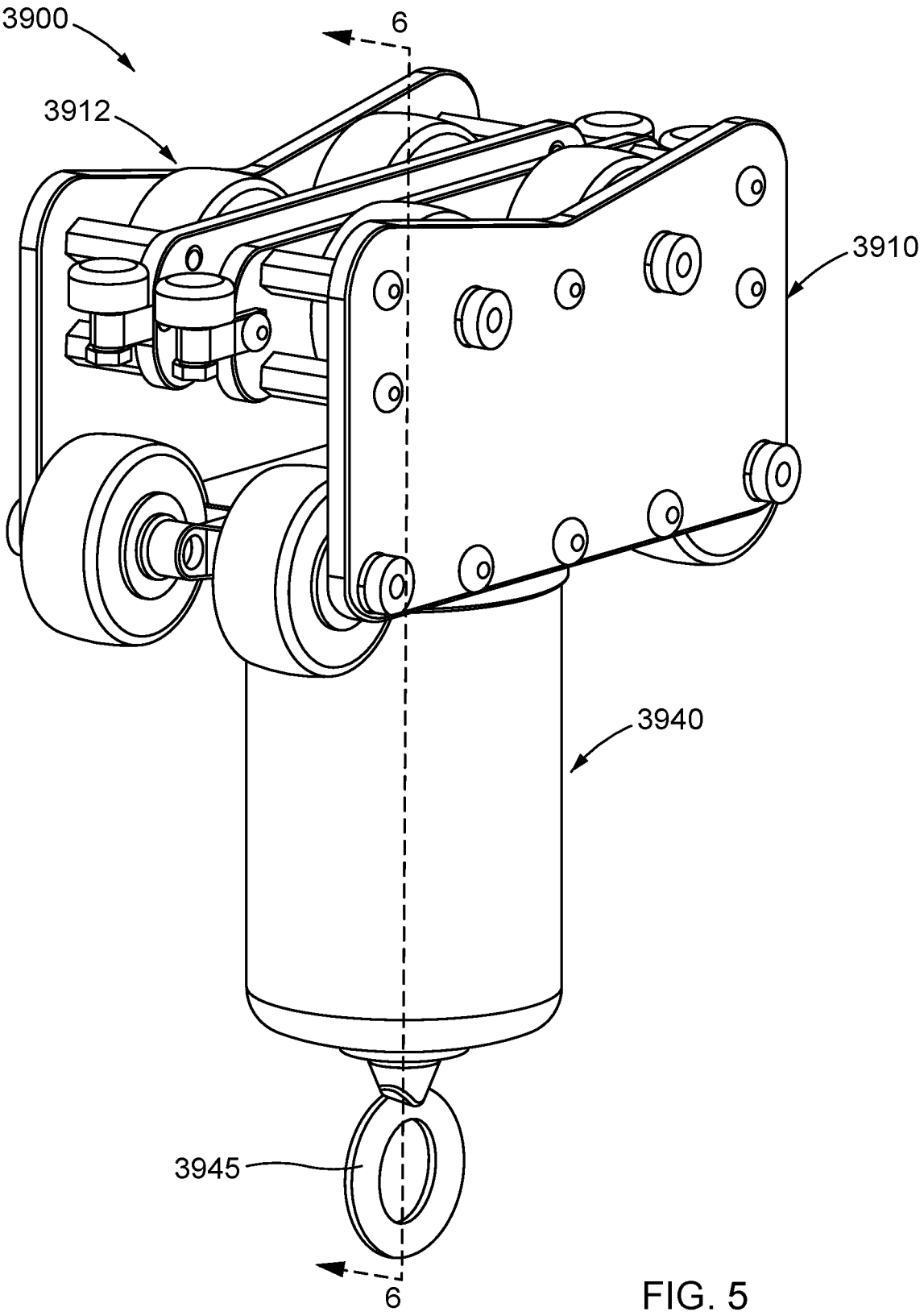
FIG. 5 is a perspective view of a body weight support system according to another embodiment.
Figure 6:
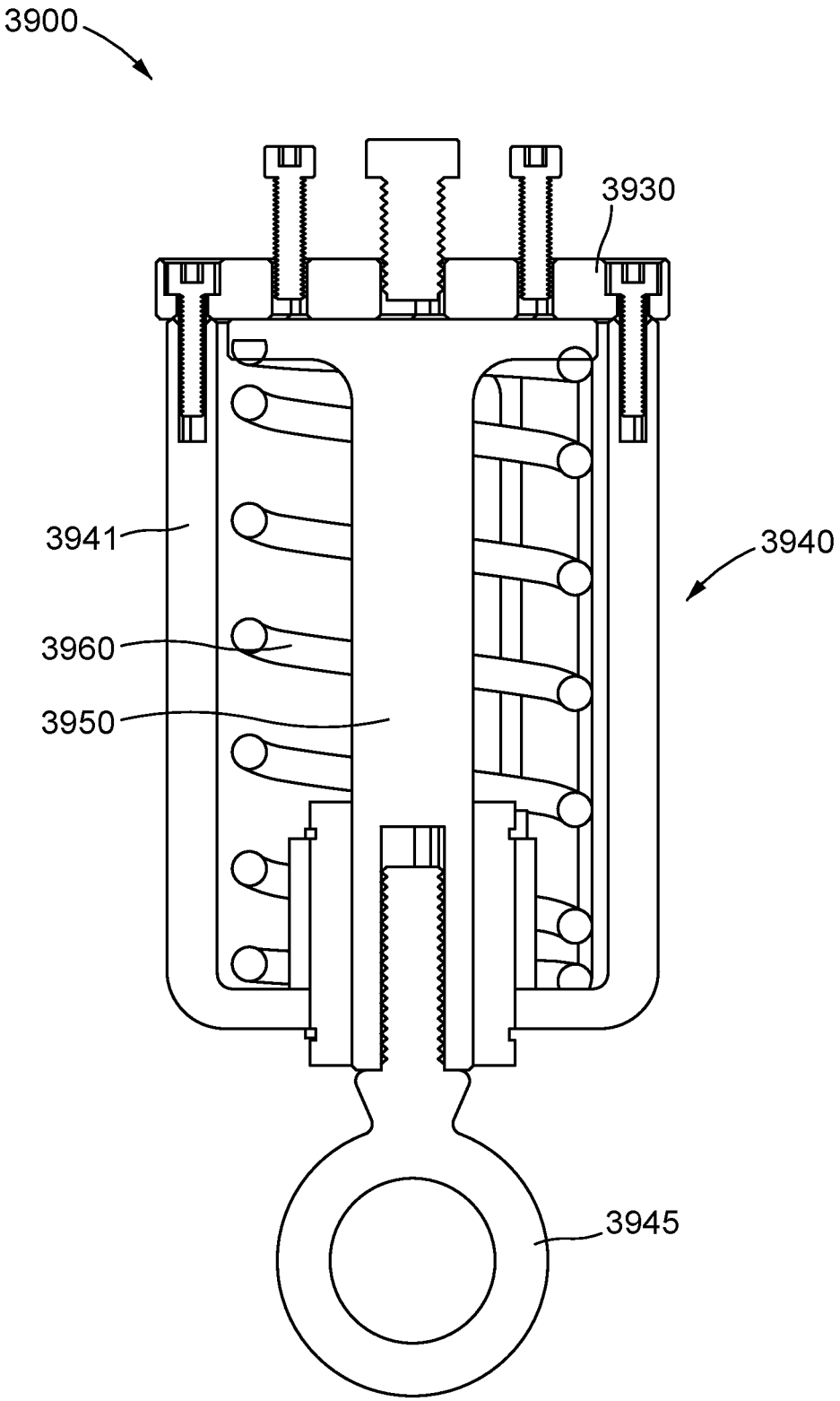
FIG. 6 is a cross sectional view of the body weight support system of FIG. 5 taken along the line 6-6.

While the patient support system 2000 is described above with reference to FIGS. 2-4 as actively supporting a portion of the body weight of the user, in some embodiments, a patient support system can passively (i.e., not actively) support a portion of the body weight of a patient/user. For example, FIGS. 5 and 6 illustrate a body weight support system or support member 3900 according to an embodiment. The body weight support system 3900 (also referred to herein as "support system" or "support member") can be used to support a portion of a user's body weight, for example, during gait therapy, gait training, or the like. The support system 3900 can be movably coupled to a support track (not shown) that is configured to support the weight of the support system 3900 and the weight of the user utilizing the support system 3900. The support track can be, for example, similar to or the same as the support track 2050 described above. In some embodiments, the support system 3900 can be substantially similar to a passive support system described in detail in the '627 publication. Thus, portions of the support system 3900 are not described in detail herein.

The support system 3900 includes a first coupling portion 3910 and a second coupling portion 3940. The first coupling portion 3910 can be any suitable shape, size, and/or configuration. For example, the first coupling portion 3910 can include any number of wheels configured to selective engage a portion of a support track to movably suspend the support system 3900 therefrom. In the embodiment shown in FIGS. 5 and 6, for example, the first coupling portion 3910 can be arranged to movably couple to a support track having an I-shaped cross-section (e.g., similar to or the same as the support track 2050). Accordingly, the first coupling portion 3910 includes a set of wheels 3912 configured to engage, for example, a horizontal portion of the support track, as well as a vertical portion of the support track to movably suspend the support system 3900 therefrom. Moreover, while the first drive assembly 2310 of the support system 2000 is described above as being actively moved along the support track 2050 in response to a rotational output from the motor 2311, in this embodiment, the set of wheels 3912 are in a passive arrangement. That is to say, the set of wheels are not rotated along a support track in response to an output of a motor. Rather, each wheel included in the set of wheels 3912 is configured to rotate along the track in response to a force exerted by a user or user operably coupled to the support system 3900 (e.g., via a tether or the like, not shown in FIGS. 5 and 6). In other words, the arrangement of the first coupling portion 3910 is such that the support system 3900 is passively moved along the support track.

The second coupling portion 3940 includes a cylinder 3941, an attachment member 3945, a piston 3950, and an energy storage member 3960. The cylinder 3941 is coupled to the base 3930 and is configured to house the spring 3960 and at least a portion of the piston 3950. The energy storage member 3960 can be any suitable device configured to move between a first configuration having lower potential energy and a second configuration having a higher potential energy. For example, as shown in FIG. 6, the energy storage member 3960 can be a spring that is compressed when moved to its second configuration. The piston 3950 has a first end portion that is in contact with a portion of the energy storage member 3960 and a second end portion that is coupled to the attachment mechanism 3945. The attachment mechanism 3945 includes an eyelet or annular protrusion that is disposed outside of the cylinder 3941 and that is configured to be coupled to, for example, a harness worn by a user. In this manner, a portion of the harness such as a hook or the like can be coupled to the attachment mechanism 3945 to couple the user to the support system 3900.

In use, the user can be coupled to the support system 3900 (e.g., via a harness, tether, and/or patient attachment mechanism) such that the support system 3900 supports at least a portion of the body weight of the user. In this manner, the user can walk along a path associated with the support track (not shown). With the support system 3900 coupled to the user, the movement of the user moves the support system 3900 along the support track. Similarly stated, the user pulls the support system 3900 along the support track. In some instances, a user may stumble while walking, thereby increasing the amount of force exerted on the support system 3900. In such instances, the increase in force exerted on the support system 3900 can be sufficient to cause the energy storage member 3960 to move from its first configuration toward its second configuration (e.g., compress). In this manner, the piston 3950 can move relative to the cylinder 3941 and the energy storage member 3960 can absorb at least a portion of the increase in the force exerted on the support structure 3900. Thus, if the user stumbles the support system 3900 can dampen the impulse experienced by the user that would otherwise result in known passive support systems 3900. In this manner, the patient support system 3900 can be configured to passively support at least a portion of the body weight of a user, as described in detail in the '627 publication.

Figure 7:
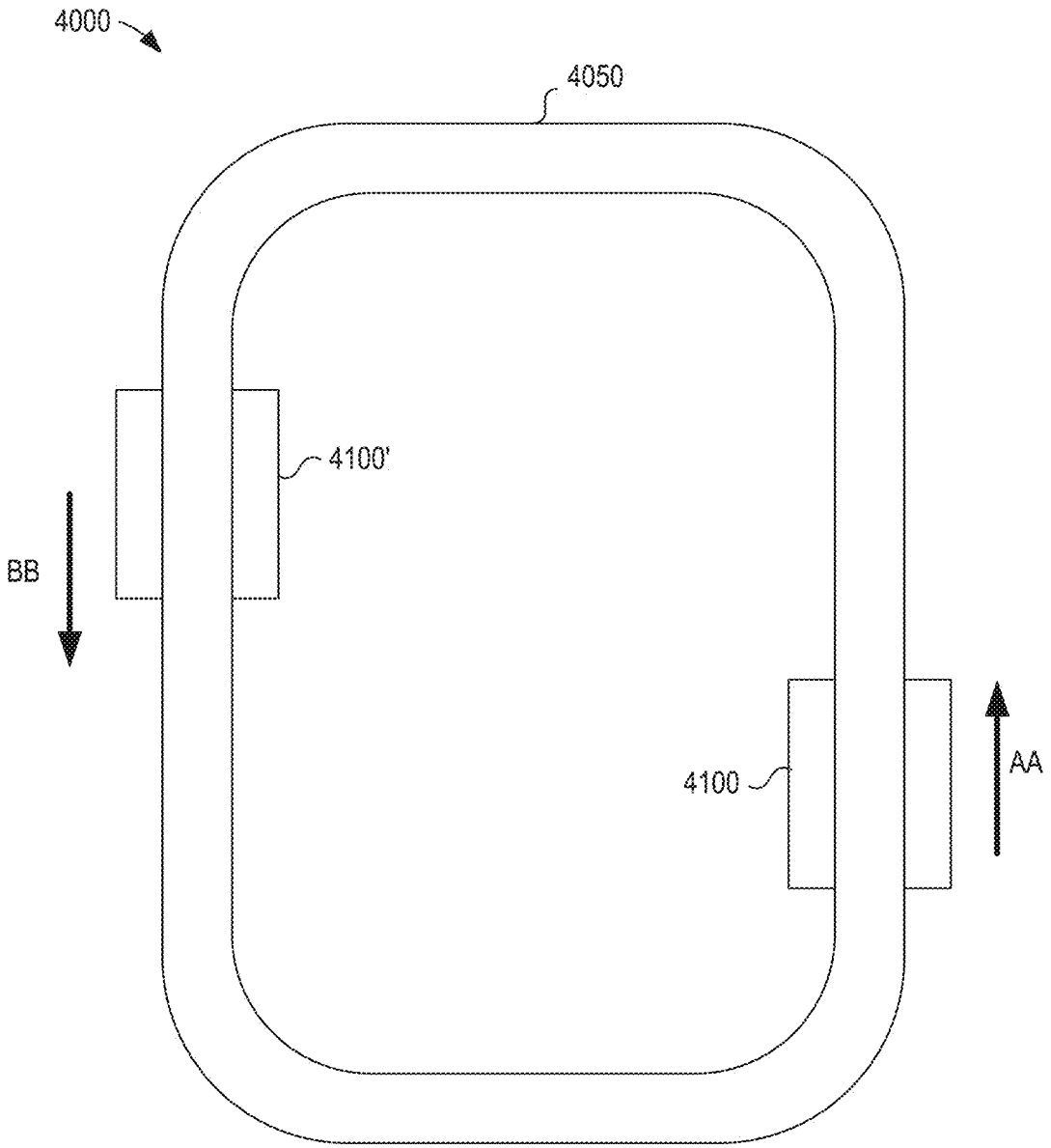
FIG. 7 is a schematic illustration of a body weight support system according to an embodiment.

Although not shown in the support system 2000 of FIGS. 2-4 or the support system 3900 of FIGS. 5 and 6, in some embodiments, one or more active support system (e.g., support system 2000) and/or one or more passive support system (e.g., 3900) can be disposed about a similar support track and can be utilized at the same time. For example, FIG. 7 is a schematic illustration of a support system 4000 according to an embodiment. The support system 4000 includes a support track 4050, a first support member 4100, and a second support member 4100'. The support system 4000 can be used to support at least a portion of the body weight of one or more users during, for example, gait therapy (e.g., after injury), gait training (e.g., low gravity simulation), or the like. The support track 4050 is configured to support the weight of the first support member 4100 and the second support member 4100' and the weight of the user utilizing the first support member 4100 and/or the second support member 4100'.

As shown in FIG. 7, the support track 4050 can form a closed loop track. The support track 4050 can be similar to or the same as the support track 2050, described above with reference to FIGS. 2 and 3. In some embodiments, the first support member 4100 and/or the second support member 4100' can be similar to or the same as the trolley 2100, described above with reference to FIGS. 2-4. In other embodiments, the first support member 4100 and/or the second support member 4100' can be similar to or the same as the support system 3900 described above with reference to FIGS. 5 and 6. In still other embodiments, the first support member 4100 can be similar to or the same as the trolley 2100 while the second support member 4100' can be similar to or the same as the support system 3900. In this manner, the first support member 4100 and the second support member 4100' can be hung from the support track 4050 and configured to support at least a portion of a user's weight, as described in detail above.

In some embodiments, a first user (not shown in FIG. 7) can be coupled to the first support member 4100 and a second user (not shown in FIG. 7) can be coupled to the second support member 4100' with both support members 4100 and 4100' being suspended from the support tack 4050. As shown in FIG. 7, the first support member 4100 can move in the direction of the arrow AA in response to a movement of the first user coupled thereto. Similarly, the second support member 4100' can be moved in the direction of the arrow BB in response to a movement of the second user coupled thereto. In other instances, the first support member 4100 and the second support member 4100' can be configured to collectively support a patient and/or user.

Although not shown in FIG. 7 the first support member 4100, the second support member 4100', and/or the track 4050 can include a collision avoidance and/or mitigation system that is configured to prevent and/or mitigate a collision of the first support member 4100 and the second support member 4100'. For example, in some embodiments, the first support member 4100 can include a sensor (e.g., an ultrasonic proximity sensor or the like) configured to sense the relative position of the first support member 4100 relative to the second support member 4100'. Thus, when the distance between the first support member 4100 and the second support member 4100' approaches a predetermined threshold (e.g., a minimum distance), an electronic system included in the first support member 4100 can send a signal to a drive system (not shown) to increase or decrease a rotational velocity of one or more drive wheels. In some embodiments, the support system 4000 can include any suitable collision avoidance and/or mitigation system such as those described in detail in the '627 publication and/or any suitable combination of those described therein. In some embodiments, the first support member 4100 and/or the second support member 4100' can include a mechanical bumper, padding, elastomers, shock absorbers, and/or the like configured to absorb energy associated with a collision between the first support member 4100 and the second support member 4100'. Thus, a collision of the first support member 4100 and the second support member 4100' can be avoided and/or an impact associated with a collision can be mitigated, which in turn, can prevent damage to the support members 4100 and 4100' and/or injury to the users or patients using the support system 4000.

Although the support system 4000 is shown and described as including the first support member 4100 and the second support member 4100', in other embodiments, the support system 4000 can include any suitable number of support members movably coupled to the support track 4050. The support members included in the support system 4000 can be any combination of active support members and/or passive support members.

Figure 8:
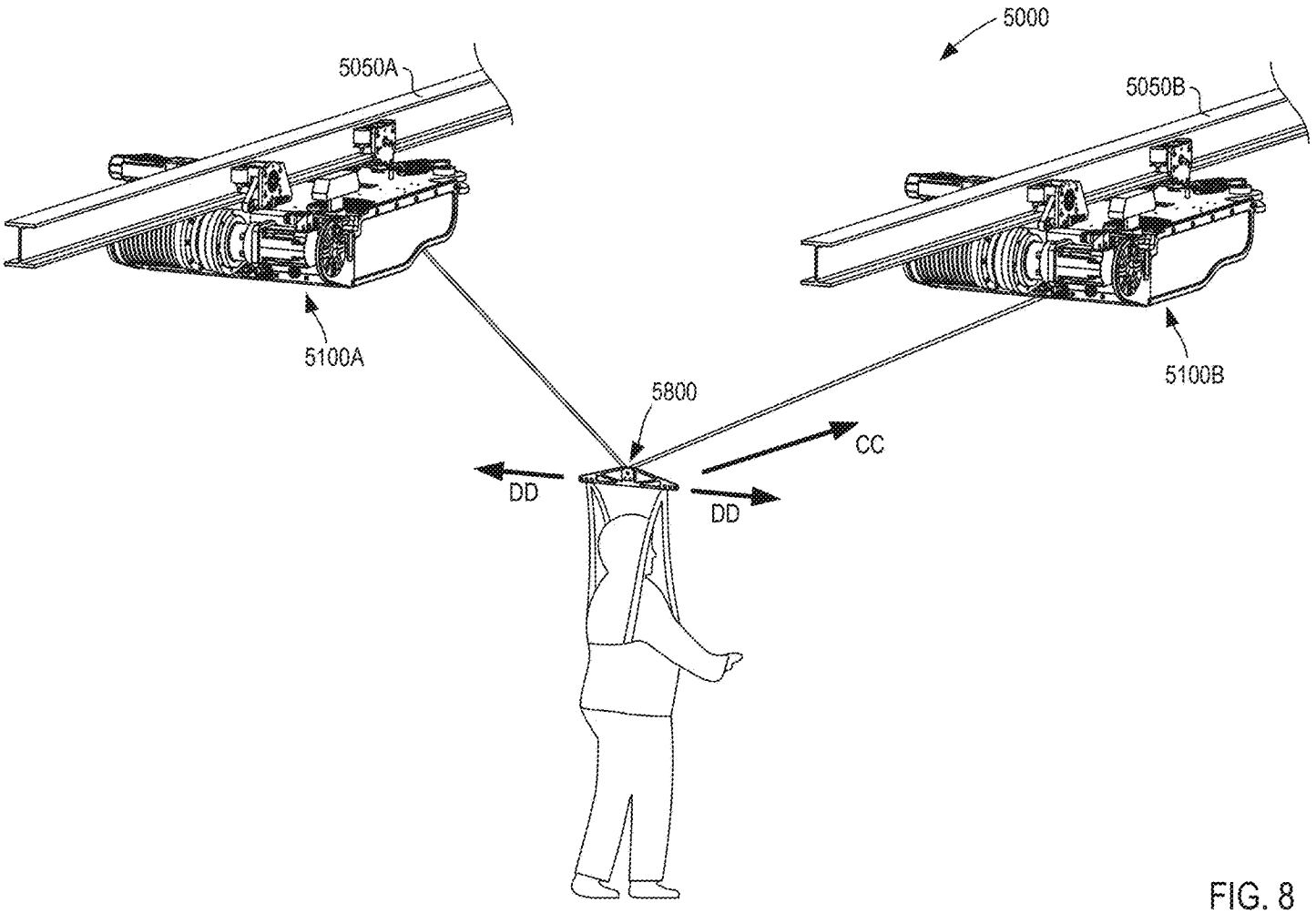
FIG. 8 is a schematic illustration of a body weight support system according to another embodiment.

While the support system 4000 is shown and described as including the support members 4100 and 4100' being movably suspended from the support track 4050 (i.e., a single support track), in other embodiments, a support system can be configured to support a user with two support members, each of which is movably suspended from a different support track. For example, FIG. 8 illustrates a support system 5000 according to an embodiment. The support system 5000 includes a first support member 5100A movably suspended from a first support track 5050A and a second support member 5100B movably suspended from a second support track 5050B. In some embodiments, the first support track 5050A and the second support track 5050B can be, for example, substantially parallel such the first support member 5100A and the second support member 5100B move along substantially similar paths as the support members 5100A and 5100B move along the support tracks 5050A and 5050B, respectively. As shown in FIG. 8 and described in further detail herein, the first support member 5100A and the second support member 5100B are configured to collectively support a user.

The support members 5100A and 5100B can be any suitable support members. For example, in some embodiments, the support members 5100A and 5100B can be similar to or the same as the trolley 2100 described above with reference to FIGS. 2-4. In other embodiments, the support members 5100A and 5100B can be similar to or the same as the support system or support member 3900 described above with reference to FIGS. 5 and 6. Moreover, the support system 5000 can include any combination of different support members as described above with reference to the support system 4000. Although not shown in FIG. 8, in some embodiments, the support system 5000 can include multiple power rails, each of which is configured to provide electric power to one support member 5100A or 5100B. In other embodiments, the support system 5000 can include a single power rail configured to provide electric power to at least one of the support members 5100A and/or 5100B.

In the embodiment shown in FIG. 8, the first support member 5100A and the second support member 5100B are each similar to or the same as the trolley 2100 described above with reference to FIGS. 2-4. Thus, the support members 5100A and 5100B are not described in further detail herein. As shown, the support members 5100A and 5100B are coupled to a single patient attachment mechanism 5800 (e.g., via a tether of each support member, as described above with reference to the support system 2000). The patient attachment mechanism 5800 can be any suitable attachment member, device, mechanism, assembly, etc. For example, in some embodiments, the patient attachment mechanism can be a hanger, a rod, a bar, one or more hooks, and/or any other suitable means for attaching the tether of each support mechanism to a harness or other article worn by the patient. The patient attachment mechanism 5800 can be, for example, a static device or mechanism (e.g., does not include components that are configured to move relative to other components) or can be a dynamic device or mechanism (e.g., includes one or more components configured to move relative to one or more other components). In some embodiments, the patient attachment mechanism 5800 can be similar to or the same as the patient attachment mechanism 2800 described above with reference to FIG. 4. Thus, the patient support mechanism 5800 is not described in further detail herein.

The arrangement of the support system 5000 is such that the first support member 5100A and the second support member 5100B collectively support at least a portion of the weight of a user as the user walks in a given path. In this manner, the support members 5100A and 5100B can move along the support tracks 5050A and 5050B, respectively when the user walks in a direction substantially aligned with the support tracks 5050A and 5050B, as indicated by the arrow CC in FIG. 8. For example, the support members 5100A and 5100B can each be configured to activate, control, and/or otherwise operate a drive system (e.g., similar to the drive system 2300) and/or a patient support mechanism (e.g., similar to the patient support mechanism 2500) in response to a change in force exerted on the tether of each support member 5100A and 5100B. Similarly, the support members 5100A and 5100B can each be configured to respond (e.g., operate the drive system and/or the patient support mechanism) in response to a movement of the user in a lateral or transverse direction, as indicated by the arrows DD in FIG. 8.

In some instances, the first support member 5100A and the second support member 5100B can each respond in a substantially similar and concurrent manner to a change in force exerted on the respective tethers. In other instances, the first support member 5100A and the second support member 5100B can respond differently to the change in force exerted on the respective tethers. In other words, the first support member 5100A can respond to the change in force on its tether independent of a response of the second support member 5100B or vice versa. In other instances, the first support member 5100A and the second support member 5100B can be in electrical and/or electronic communication such that the response of the first support member 5100A and/or the second support member 5100B is according to, for example, a calculated and/or determined system response to the force exerted on the tethers. That is to say, a controller of the first and/or second support member 5100A and/or 5100B or a controller configured to at least partially control both the first and second support members 5100A and 5100B can determine a magnitude and direction of a force and can calculate and/or determine a system response that can include a change in operating condition of at least one of the first support member 5100A and the second support member 5100B.

In some instances, the user can walk along a predetermined path that can include, for example, curves and/or turns such that the user moves in both the CC direction and the DD direction (see FIG. 8). In such instances, the support members 5100A and 5100B can be configured to react and/or respond based on, for example, a length of the respective tethers, an angle of the respective tethers in a forward and rearward direction (e.g., the CC direction in FIG. 8), an angle of the respective tethers in a transverse or lateral direction (e.g., the DD direction in FIG. 8), a tension along or within the respective tethers, and/or any other suitable operating condition and/or any suitable combinations thereof. In some embodiments, one or more sensors, encoders, load cells, transducers, gauges, etc. can be configured to detect a change in the configuration, arrangement, and/or orientation of the tethers and/or other suitable component of the support members 5100A and/or 5100B and can send a signal that includes information regarding the change to the controller of the associated trolley and/or to a system level controller configured to at least partially control the support members 5100A and 5100B. The arrangement of the support system 5000 can be such that the support members 5100A and 5100B support at least a portion of the patient's and/or user's weight during a fall, stumble, slip, trip, etc. in any direction.

For example, in some instances, the first support member 5100A can respond to a decrease in force exerted on its tether while the second support member 5100B can respond to a concurrent increase in force exerted on its tether (e.g., indicative of the user moving and/or falling, etc. in a direction toward the first support member 5100A and away from the second support member 5100B). In such instances, the responses of the first support member 5100A and the second support member 5100B, while being different, can produce and/or exert a collective and/or resultant force in, for example, a predetermined direction such that the support members 5100A and 5100B collectively support the user. The collective and/or resultant force exerted, for example, on the patient attachment mechanism 5800 can be substantially similar to a force that would otherwise be exerted on the patient attachment mechanism 5800 using a support system including a single support member. In some instances, the collective and/or resultant force exerted on the patient attachment mechanism 5800 can be, for example, in a vertical direction.

While the support system 5000 is shown in FIG. 8 as including two support tracks 5050A and 5050B with support members 5100A and 5100B, respectively, being movably suspended therefrom, in other embodiments, a support system can include any suitable number of support tracks and support members. For example, in some embodiments, a support system can include more than two support tracks and can include at least one support member movably suspended from each of the support tracks. By way of example, in some embodiments, the support system 5000 shown in FIG. 8, can include a third support track that is disposed between the first support track 5050A and the second support track 5050B and from which a third support member is movably suspended. In such embodiments, the third support track and third support member can be, for example, substantially overhead of the user. As such, the three support members can collectively respond to a force exerted by a user to support at least a portion of the user's weight (as described in detail above).

As described above, the multiple support members configured to collectively support a single patient can be similar or the same or can be different (e.g., can be arranged similar to the support member 2100 or the support member 3900). In some embodiments, the support system can be arranged such that one of the support members is configured to be a primary support member while one or more additional support members is configured to be a secondary support member. For example, in some embodiments, a first support member can be movably suspended from a first support track that is aligned with (e.g., above or directly above) a path along which a user will walk while a second support member can be movably suspended from a second support track that is offset from the path.

In some such embodiments, the first support member can be a primary support member configured to support a first portion of the user's weight and the second support member can be a secondary support member configured to support a second portion of the user's weight. In some instances, a user may walk along the path with little or no lateral movement, in which case, the first portion of the user's weight can be substantially all of the user's weight and/or can be greater than the second portion of the user's weight. If, however, the user falls and/or otherwise moves in a lateral direction, the second portion of the user's weight supported by the second support member can increase while the first portion of the user's weight support by the first support member can decrease. In other words, the second support member (e.g., the secondary support member) can be configured to support at least a portion of the user's weight (e.g., the second portion) in response to the user falling and/or otherwise moving in a lateral direction.

In some embodiments, the first support member (e.g., the primary support member) can be similar to or the same as, for example, the support member 2100 and the second support member (e.g., the secondary support member) can be similar to or the same as, for example, the support member 3900. Although described above as including two support tracks and two support members, in some embodiments, a support system can include a primary support member and at least two secondary support members. For example, in some embodiments, a support system can include a primary support member movably suspended from a primary support track and two secondary support members movably suspended from a respective secondary support track on either side of the primary support track. In such embodiments, the secondary support members can be configured to support at least a portion of the user's weight in response to the user falling or otherwise moving in a corresponding lateral direction (as described above). In some such embodiments, the primary support member can be similar to or the same as the support member 2100 while the secondary support members can be similar to or the same as the support member 3900.

While the support tracks 5050A and 5050B are shown in FIG. 8 and described above as being substantially parallel, in other embodiments, a support system can include two or more support tracks that are non-parallel. In some embodiments, the non-parallel support tracks can follow a substantially similar path. In other embodiments, a first support track can follow a non-linear path and a second support track can follow a linear path. In still other embodiments, the non-parallel support tracks can have any suitable arrangement.

A trolley (e.g., a support member such as the support members 5100A and/or 5100B) can be movably suspended from each of the non-parallel support tracks and can be coupled to a single patient attachment mechanism (e.g., the patient attachment mechanism 5800). In this manner, the trolleys can collectively support a patient in substantially the same manner as described above with reference to the support system 5000. The support members or trolleys suspended from the non-parallel tracks can be similar or substantially the same or can be different and can be suspended from either support track. For example, a first support members can be substantially similar to or the same as the support member 2100 while a second support member can be substantially similar to or the same as the support member 3900. In some such embodiments, the first support member can be a primary support member while the second support member is a secondary support member, as described above. In such embodiments, the first support member can be movably suspended from a first support track that is disposed above and/or that is substantially aligned with a path along which a user will walk while the second support member can be movably suspended from a second support track that is offset from the path. Moreover, in some embodiments, the first support track can be arranged in a non-linear manner (e.g., can be curved or otherwise not straight) while the second support track can be arranged in a linear manner (e.g., can be straight) and can be configured to augment the support provided by the first support member, for example, in response to the user moving in a lateral direction (e.g., as described above).

Figure 9:
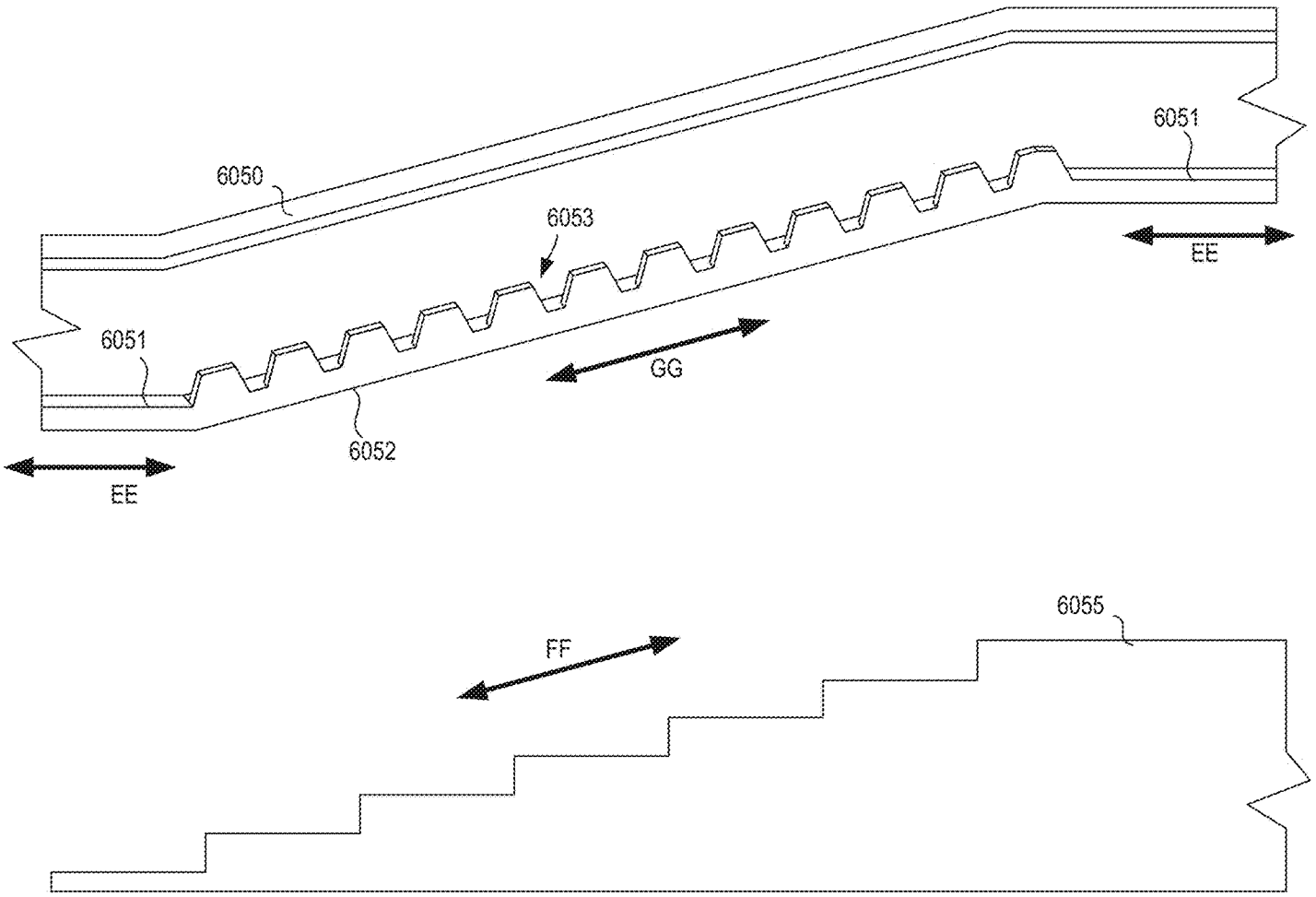
FIG. 9 is a schematic illustration of a portion of a support track configured for use in a body weight support system according to an embodiment.

The support systems 1000, 2000, 3000, 4000, and/or 5000 can be configured for use with any suitable support track. In some embodiments, for example those described above, a support member and/or trolley can be movably suspended from a support track with a substantially I-shaped cross-section and with substantially constant vertical position (e.g., similar to the support track 2050, 4050, 5050A, and/or 5050B). That is to say, the support track can have a slope substantially equal to zero. In other embodiments, however, a support system can be configured for use with a support track (or portion thereof) having a nonzero slope. For example, FIG. 9 is a schematic illustration of a portion of a support track 6050 according to an embodiment. Aspects of the support track 6050 can be similar to, for example, the support track 2050. For example, the support track 6050 can have a substantially I-shaped cross-sectional shape and/or the like.

The support track 6050 can differ from the support track 2050, however, with the inclusion of at least one portion having a slope substantially equal to zero (referred to herein as a flat portion 6051) and at least one portion having a non-zero slope (referred to herein as a sloped portion 6052). As described above with reference to the support track 2050, a drive system of a trolley (e.g., the trolley 2100) can include a set of wheels configured to move along a surface of the support track 2050 to move the trolley relative thereto. For example, in some instances, the set of wheels can be in contact with a flat portion 6051 of the support track 6050 and configured to roll along the flat portion 6051 to move the trolley relative to the support track 6050, as indicated by the arrows EE in FIG. 9. As such, the support track 6050 and a trolley movably suspended therefrom can be substantially similar in form and/or function to the support track 2050 and the trolley 2100, respectively.

In some instances, however, a user may wish to walk along a sloped surface such as, for example, a ramp and/or the like. In other instances, a user may wish to walk up or down a flight of stairs 6055, as indicated by the arrow FF in FIG. 9. In this manner, a distance between the user and an otherwise flat portion of a support track would be decreased, which may, in some instances, result in a change in one or more operating conditions of the support system 6000. Moreover, in some instances, a flight of stairs (e.g., the stairs 6055) may extend to a vertical position that is greater than a vertical position of the support track 6050 (e.g., above a ceiling to which the support track 6050 is mounted), thereby resulting in an undesirable configuration.

Thus, in some instances, the sloped portion 6052 of the support track 6050 can be such that a distance between the user and the support track 6050 remains substantially constant as the user walks up and/or down, for example, the stairs 6055 (FIG. 9). Similarly, a distance between the flat portion 6051 of the support track 6050 and a flat surface on which a user walks can be substantially the same as a distance between the sloped portion 6052 of the support track 6050 and a sloped surface on which the user walks (or a plane formed by at least a portion of the surface, such as a tangential plane formed by the stairs 6055). In some instances, the arrangement of the drive system of the trolley or support member can be such that the wheels move along a surface of the sloped portion 6052 in a manner substantially similar when the wheels move along the surface of the flat portion 6051. As such, the trolley and/or support member can move along the sloped portion 6052 and/or the flat portion 6051 to support the user. In other instances, however, movement of the wheels along the sloped portion 6052 may result in a loss of traction and/or slippage of at least some of the wheels as the wheels move along the surface of the sloped portion 6052. In such instances, a change in force exerted in response to, for example, the user falling or the like may be sufficient to result in a loss of traction of the wheels on the sloped portion 6052 of the support track 6050 and, as such, an undesired, inaccurate, and/or insufficient response to the change in force.

Figure 10:
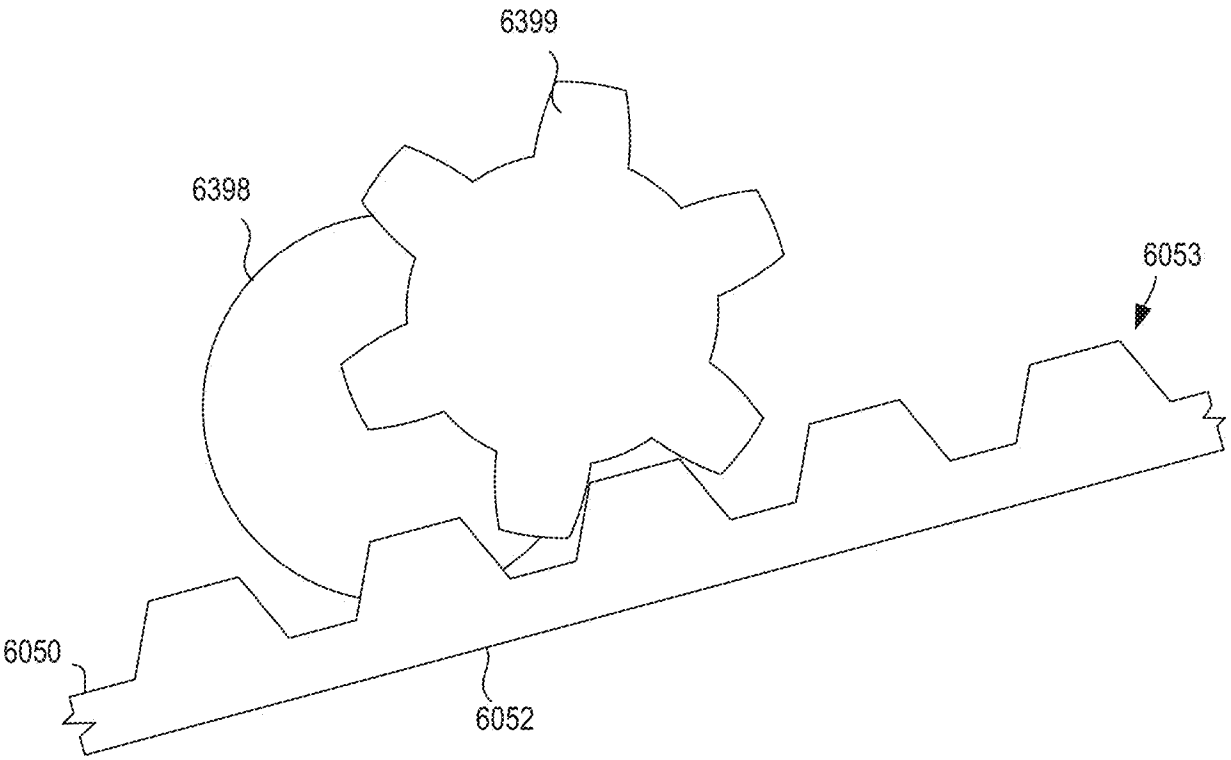
FIG. 10 is a schematic illustration of a portion of the support track shown in FIG. 9 and a portion of a trolley of the body weight support system.

Accordingly, in the embodiment shown in FIGS. 9 and 10, the sloped portion 6052 of the support track 6050 includes a set of protrusions 6053 (e.g., a rack, a set of teeth, etc.) configured to be selectively engaged by a portion of the trolley and/or support member. For example, in some embodiments, a drive system of a trolley (e.g., the drive system 2300 of the trolley 2100) can include a sprocket, gear, pinion, etc. (not shown) that can selectively engage the protrusions 6053 as the trolley moves along the sloped portion 6052. More specifically, as shown in FIG. 10, such a drive system can include one or more wheels 6398 configured to move along a substantially flat or smooth surface of the support track 6050 and one or more gears 6399 configured to be placed in contact and/or engagement with the set of protrusions 6053 as the drive system moves along the sloped portion 6052 of the support track. As the drive system moves along the sloped portion 6052 of the support track 6050 and approaches a flat portion 6051 of the support track 6050, the gear 6399 can be removed from contact with and/or can be disengaged from the set of protrusions 6053 while the one or more wheels 6398 remain (s) in contact with the surface of the support track 6050 to continue to move the trolley along the support track 6050. In some embodiments, the drive system can be configured to power (e.g., via a motor) the gear 6399 such that the gear 6399 rotates along the set of protrusions 6053 (e.g., similar to a rack and pinion or the like).

In some instances, the engagement between the gear 6399 and the set of protrusions 6053 along the sloped portion 6052 of the support track 6050 can be operable in maintaining a desired amount of traction and/or can otherwise limit and/or substantially prevent slippage of the drive system relative to the support track 6050. For example, in some embodiments, the engagement of a set of teeth or the like of the gear 6399 and the set of protrusions 6053 of the sloped portion 6052 can prevent a translational movement of the gear 6399 relative to the support track 6050 without rotating the gear 6399. Thus, the drive system can be configured to selectively control the rotation of the gear 6399 via, for example, the motor, a clutch, a brake, and/or any other suitable means. In this manner, the trolley and/or support member can move along the sloped portion 6052 substantially without losing traction to support the user as the user walks up or down, for example, the stairs 6055, as shown by the arrows GG and FF, respectively, in FIG. 9.

Figure 11:
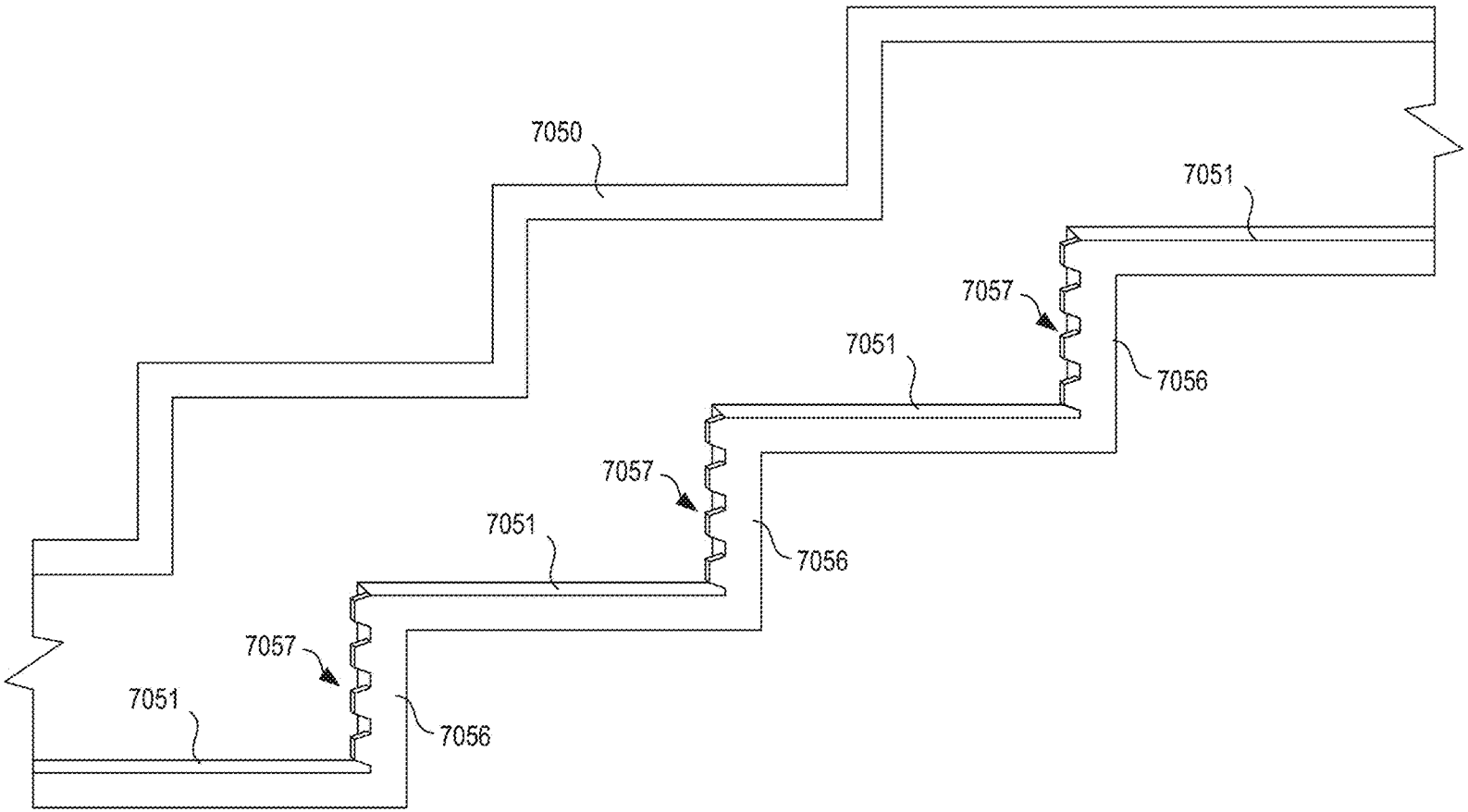
FIG. 11 is a schematic illustration of a portion of a support track configured for use in a body weight support system according to another embodiment.

While the support track 6050 is shown as including the sloped portion 6052, in other embodiments, a support track can be arranged in any suitable manner such that at least a portion of the support track has a non-zero slope. For example, FIG. 11 is a schematic illustration of a support track 7050 according to an embodiment. Aspects of the support track 7050 can be substantially similar to the support track 6050 described above with reference to FIGS. 9 and 10. The support track 7050, however, can differ from the support track 6050 by including a set of flat portions 7051 (e.g., portions of the support track 6050 with a slope substantially equal to zero) and one or more vertical portions 7056. That is to say, the support track 7050 can form a set of steps or stairs, as shown in FIG. 11. As described above with reference to the sloped portion 6052 of the support track 6050, the vertical portions 7056 of the support track 7050 include and/or form a set of protrusions 7057 or the like. The protrusions 7057 can be substantially similar in at least function to the set of protrusions 6053 described above with reference to the support track 6050. Thus, a gear or the like included in a drive system of a trolley (e.g., as shown in FIG. 10) can selectively engage the set of protrusions to move the trolley along the set of steps of the support track 7050. Although not shown in FIG. 11, in some embodiments, the support track 7050 can include a set of protrusions disposed on an opposing surface of the support track 7050 (e.g., an upper or left inner surface of the support track 7050). Thus, the gear of the drive system can be configured to engage the set of protrusions 7057 disposed on both inner, vertical surfaces of the vertical portions 7056 of the support track 7050, which can result in a vertical movement of the trolley. Moreover, as described above, the gear of the drive system can be operably coupled to a motor, brake, clutch, and/or the like, which in turn, allows the trolley (e.g., a processor of an electronic system or the like) to selectively control and/or allow a rotation of the gear. Thus, the trolley or the like can move along the set of steps as the user walks up or down the stairs (e.g., the stair 6055 in FIG. 9).

Figure 12:
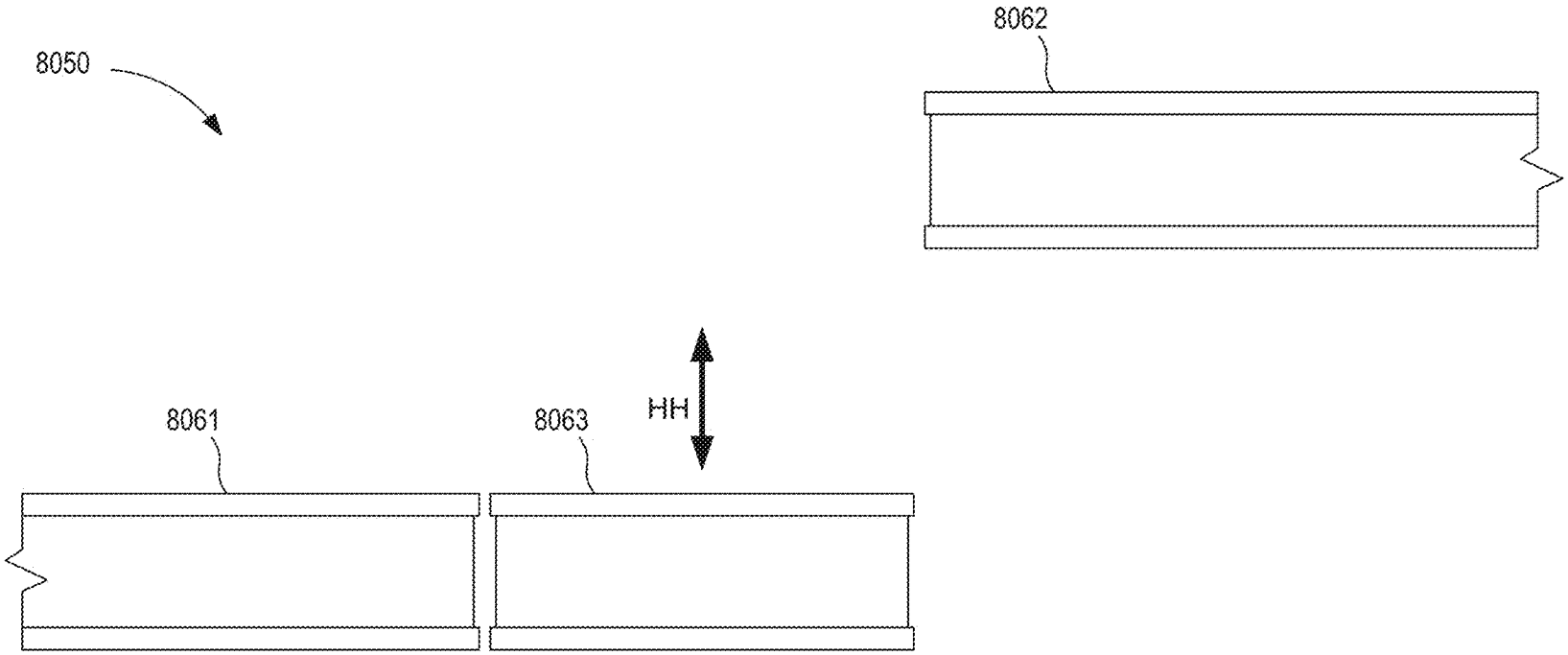
FIG. 12 is a schematic illustration of at least a portion of a support track configured for use in a body weight support system according to another embodiment.

While the support track 7050 is described above as including the vertical portions 7056 and the set of protrusions 7057 configured to allow for vertical movement of a trolley, in other embodiments, a support track can have any suitable arrangement configured to allow for vertical and/or horizontal movement of the trolley. For example, FIG. 12 is a schematic illustration of a support track 8050 according to an embodiment. The support track 8050 includes one or more sections configured to move in a horizontal or a vertical motion relative to the remaining sections of the support track 8050. Expanding further, the support track 8050 includes a first portion 8061 that is disposed at a first height or elevation, a second portion 8062 that is disposed at a second height or elevation different from the first height or elevation, and a third portion 8063 disposed between the first portion and the second portion and configured to move between the first height or elevation and the second height or elevation. In other words, the third portion 8063 of the support track 8050 can be an elevator portion or the like configured to move along a vertical axis in response to an actuation and/or input, as indicated by the arrow HH in FIG. 12. For example, in some embodiments, the third portion 8063 of the support track 8050 can be operably coupled to a motor or the like (not shown in FIG. 11) configured to move the third portion 8063 in the vertical direction (e.g., via a chain, tether, mechanical linkage, gear system, rack and pinion system, hydraulic system, pneumatic system, etc.). In some embodiments, the third portion 8063 of the support track 8050 (e.g., the elevator portion) can be moved in a horizontal direction concurrently with the movement in the vertical direction or independent from the movement in the vertical direction.

In use, for example, a trolley (such as those described herein) can move along a length of the support track 8050 from a first position, in which the trolley is movably suspended from the first portion 8061, to a second position, in which the trolley is movably suspended from the third portion 8063. In response to an actuation and/or input, the third portion 8063 can then be moved along the vertical axis from the first height, in which the third portion 8063 is adjacent to and substantially horizontally aligned with the first portion 8061 of the support track 8050, to the second height, in which the third portion 8063 is adjacent to and substantially horizontally aligned with the second portion 8062 of the support track 8050. With the third portion 8063 of the support track 8050 disposed at the second height and adjacent to the second portion 8062, the trolley can be moved along a length of the support track 8050 from the second position, in which the trolley is movably suspended from the third portion 8063, to a third position, in which the trolley is movably suspended from the second portion 8062 of the support track 8050. Thus, the support track 8050 can be configured to move one or more trolleys in a vertical (and/or horizontal) direction. In some instances, such vertical movement can facilitate the trolley in supporting a patient as the patient moves a vertical direction and/or otherwise moves through a change in elevation. In some instances, such vertical and/or horizontal movement of the third portion 8063 of the support track 8050 can facilitate, for example, storage of the trolley (e.g., the trolley can be in a storage position when suspended from the second portion 8062 of the support track 8050.

While the third portion 8063 of the support track 8050 is shown in FIG. 12 as moving relative to the first portion 8061 and the second portion 8062, in other embodiments, the support track 8050 substantially in its entirety can be moved in a vertical and/or horizontal direction. For example, in some embodiments, a support track can be operably coupled to one or more motors and/or systems configured to move substantially the entire support track from a first position (e.g., a first height) to a second position (e.g., a second height).

Figure 13:
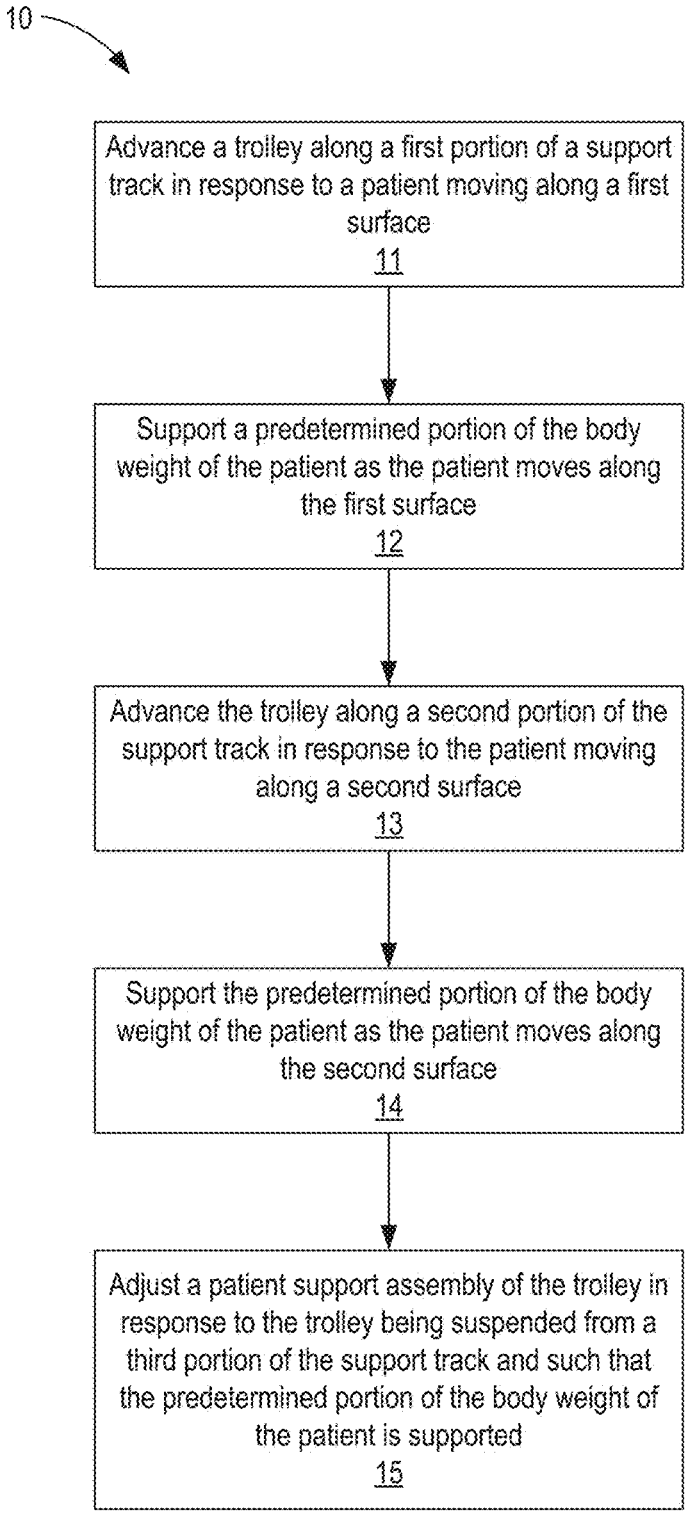
FIG. 13 is a flowchart illustrating a method of using a body weight support system according to an embodiment.

Referring to FIG. 13, a flowchart is shown illustrating a method 10 of using a body weight support system according to an embodiment. The body weight support system can be any suitable system such as those described herein (e.g., the body weight support system 2000 and/or the like). For example, in some embodiments, the body weight support system can include at least a trolley or support system (e.g., the trolley 2100 and/or the support system or support member 3900) and a support track (e.g., the support track 2050, 4050, 5050A, 5050B, 6050, 7050, and/or 8050). The trolley or support system includes, for example, a patient support assembly configured to support at least a portion of a patient's body weight and a drive assembly configured to movably suspend the trolley or support system (referred to henceforth as "trolley") from the support track.

As shown in FIG. 13, the method 10 includes advancing the trolley along a first portion of the support track in response to the patient moving along a first surface, at 11. In some embodiments, the first surface can be, for example, a flat surface and the first portion of the support track can be, for example, a flat portion of the support track (e.g., as described above with reference to the support track, 6050, 7050, and/or 8050). In some embodiments, the first surface can have a known, predetermined, and/or defined elevation and/or level. For example, in some instances, the first surface can be and/or can form a ground level or plane, a base level or plane, a reference level or plane, and/or the like, in which case an elevation of the first surface can be considered equal to zero and/or equal to any suitable reference value. Moreover, in some embodiments, the first portion of the support track can be disposed at a predetermined and/or defined distance from the first surface, as described above.

A predetermined portion of the patient's body weight is supported as the patient moves along the first surface, at 12. For example, in some embodiments, an administrator, therapist, trainer, user, etc. can set a level of body weight support that the trolley provides to the user during use. In response to the level of body weight support being set, the trolley and/or any suitable portion thereof can adjust and/or set the configuration and/or arrangement of the patient support assembly such that the trolley (e.g., via at least the patient support assembly) supports the predetermined portion of the patient's body weight.

The trolley is advanced along a second portion of the support track in response to the patient moving along a second surface that is separate from the first surface, at 13. In some embodiments, the second surface can be, for example, a flat surface and the second portion of the support track can be, for example, a flat portion of the support track (e.g., as described above with reference to the support track, 6050, 7050, and/or 8050). In some embodiments, the second surface can have a known, predetermined, and/or defined elevation and/or level. For example, in some instances, the second surface can be and/or can form a level or plane that has and/or is disposed at an elevation that is different than (e.g., higher than) the elevation of the first surface. By way of example, in some embodiments, the first surface can be a lower surface leading to a set of stairs and/or an otherwise sloped surface, and the second surface can be a surface disposed at a higher elevation and can extend from the set of stairs or the sloped surface. In such embodiments, an elevation of the first surface is less than an elevation of the second surface and the set of stairs and/or the sloped surface is disposed therebetween. As described above with reference to the first portion of the support track, in some embodiments, the second portion of the support track can be disposed at the predetermined and/or defined distance from the second surface. In other words, the first portion of the support track and the second portion of the support track are spaced substantially the same distance from the first surface and the second surface, respectively, despite the first surface and the second surface being disposed at different elevations.

The predetermined portion of the patient's body weight is supported as the patient moves along the second surface, at 14. The trolley (e.g., via at least the patient support assembly) can be configured to support the predetermined portion of the patient's body weight as the patient moves along the first surface and as the patient moves along the second surface. In other words, the portion of the patient's body weight supported by the trolley as the patient moves along the first surface is the same as the portion of the patient's body weight supported by the trolley as the patient moves along the second surface.

After advancing the trolley along the first portion of the support track and prior to advancing the trolley along the second portion of the support track, the patient support assembly is adjusted (1) in response to the trolley being suspended from a third portion of the support track disposed between the first portion and the second portion, and (2) such that the patient support assembly supports the predetermined portion of the body weight of the patient, at 15. In some embodiments, the third portion of the support track can be a sloped portion of the support track such as, for example, the sloped portion 6052 of the support track 6050 (FIGS. 9 and 10). In other embodiments, the third portion to the support track can be a portion of the support track including one or more vertical portions such as, for example, the vertical portions 7056 of the support track 7050 (FIG. 11). In still other embodiments, the third portion of the support track can be a portion of the support track configured to move relative to the first portion and the second portion such as, for example, the third portion 8063 of the support track 8050 (FIG. 12).

In some such embodiments, as the trolley moves along the third portion and/or as the third portion moves relative to the first portion of the support track and the second portion of the support track, an elevation and/or vertical position of the trolley is moved. As a result, a distance between the trolley and the patient may be changed (e.g., increased or decreased). In some embodiments, the third portion of the support track can be a sloped portion and thus, an angle of the trolley relative to the patient may be changed. Accordingly, the trolley and/or a portion thereof is configured to adjust the patient support assembly such that the trolley supports the predetermined portion of the body weight of the patient. In this manner, the trolley and/or at least the patient support assembly is configured to support the predetermined portion of the patient's body weight regardless of whether the trolley is moved along the first portion, the second portion, and/or the third portion of the support track. Said a different way, the trolley and/or at least the patient support assembly is configured to support the predetermined portion of the patient's body weight as the patient moves along the first surface, the second surface, and/or a third surface (e.g., a sloped surface, a set of stairs, etc.) regardless of a difference in an elevation of the first surface, the second surface, and/or the third surface.

Some embodiments described herein relate to a computer storage product with a non-transitory computer-readable medium (also can be referred to as a non-transitory processor-readable medium) having instructions or computer code thereon for performing various computer-implemented operations. The computer-readable medium (or processor-readable medium) is non-transitory in the sense that it does not include transitory propagating signals (e.g., propagating electromagnetic wave carrying information on a transmission medium such as space or a cable). The media and computer code (also referred to herein as code) may be those designed and constructed for the specific purpose or purposes. Examples of non-transitory computer-readable media include, but are not limited to: magnetic storage media such as hard disks, optical storage media such as Compact Disc/Digital Video Discs (CD/DVDs), Compact Disc-Read Only Memories (CD-ROMs), magneto-optical storage media such as optical disks, carrier wave signal processing modules, and hardware devices that are specially configured to store and execute program code, such as Application-Specific Integrated Circuits (ASICs), Programmable Logic Devices (PLDs), Read-Only Memory (ROM) and Random-Access Memory (RAM) devices. Other embodiments described herein relate to a computer program product, which can include, for example, the instructions and/or computer code discussed herein.

Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, FORTRAN, etc.), functional programming languages (Haskell, Erlang, etc.), logical programming languages (e.g., Prolog), object-oriented programming languages (e.g., Java, C++, etc.), or other programming languages and/or other development tools. Additional examples of computer code include, but are not limited to, control signals, encrypted code, and compressed code.

While various embodiments have been described above, it should be understood that they have been presented by way of example only, and not limitation, and as such, various changes in form and/or detail may be made. For example, while the attachment mechanism 2800 is described above with reference to FIG. 4 as including energy storage members 2850, in other embodiments, an attachment mechanism need not include an energy storage member. In such embodiments, the attachment mechanism can be coupled to, for example, the trolley 2100 and the further coupled to a harness or the like worn by a user. In such embodiments, the trolley 2100 can function in a substantially similar manner as described above.

Although the trolley 2100 is described above with reference to FIGS. 2 and 3 as including a motorized drive system 2300 and an active support mechanism 2500, in other embodiments, a trolley can include either a motorized drive system or an active support mechanism. Similarly stated, the drive system 2300 and the support mechanism 2500 can be mutually exclusive and can independently function in a similar manner to those described above.

Any portion of the apparatus and/or methods described herein may be combined in any suitable combination, unless explicitly expressed otherwise. For example, in some embodiments, the patient support mechanism 2500 of the trolley 2100 included in the support system 2000 can be replaced with a system similar to the support system 3900. In such embodiments, a cylinder, a piston, and an energy storage member can extend, for example, from the base 2210 of the housing 2200 of the trolley 2100. Expanding further, the kinetic and potential energy of the energy storage member (e.g., storage member 3960) could be actively controlled via a feedback system similar to the system described above with reference to the trolley 2100. For example, the energy storage member 3960 could be compressed air, the pressure of which could be controlled in response to a force exerted on the piston.

By way of another example, a body weight support system (e.g., such as the body weight support system 2000) can be used with any suitable support track or combination of support tracks described herein. For example, in some embodiments, a support track may include one or more sections and/or portions having an arrangement similar to the support track 6050 (FIGS. 9 and 10), the support track 7050 (FIG. 11), and/or the support track 8050 (FIG. 12). In some embodiments, portions of a support track may be interchangeable, allowing an administrator, instructor, technician, therapist, user, etc. to change one or more portions of the support track based on a therapeutic or training program. For example, in some instances, a user or patient may perform an exercise, in which the user or patient walks up or down a ramp or other sloped surface. In such instances, the support track can be arranged, for example, in a configuration similar to or the same as the support track 6050. In other instances, however, it may be desirable to switch, for example, the sloped portion 6052 of the support track 6050 for a portion of the support track 7050 including the vertical portions 7056. As such, one or more portions of the support track can be movable (e.g., via a motor and along a track or the like) to allow the one or more portions to be switched, changed, swapped, etc. In some embodiments, such portions can be movable, switchable, and/or interchangeable in a manner similar to or the same as those described in U.S. Patent Publication No. 2017/0128313 entitled, "Apparatus and Methods for Support Track and Power Rail Switching in a Body Weight Support System," filed Nov. 11, 2016, the disclosure of which is incorporated herein by reference in its entirety.

Where methods and/or schematics described above indicate certain events and/or flow patterns occurring in certain order, the ordering of certain events and/or flow patterns may be modified. Additionally certain events may be performed concurrently in parallel processes when possible, as well as performed sequentially.

What is claimed is:

1. A body weight support system, comprising:

a support track having a first portion with a slope substantially equal to zero and a second portion with a non-zero slope;

a trolley having a support assembly and a drive assembly, the support assembly configured to support at least a portion of a body weight of a user, the drive assembly configured to suspend the trolley from the support track, the drive assembly having a drive wheel in contact with and configured to move along a surface extending along each of the first portion and the second portion of the support track to move the trolley along the first portion of the support track when the user moves along a first surface and to move the trolley along the second portion of the support track when the user moves along a second surface separate from the first surface, the drive assembly having a gear configured to engage a set of protrusions formed by the surface along the second portion of the support track to increase an amount of traction as the drive wheel moves the trolley along the second portion of the support track, the surface along the first portion of the support track being devoid of protrusions such that the gear is disengaged from the support track as the drive wheel moves the trolley along the first portion of the support track; and a power rail coupled to the support track, the power rail configured to be in electrical contact with a portion of the trolley as the trolley moves along the first portion of the support track and the second portion of the support track.

2. The system of claim 1, wherein the first surface has a first elevation and the second surface has a second elevation different from the first elevation.

3. The system of claim 1, wherein the first surface has a first elevation, the support assembly configured to support a predetermined portion of the body weight of the user as the user moves along the first surface, the second surface has a second elevation different from the first elevation, the support assembly configured to support the predetermined portion of the body weight of the user as the user moves along the second surface, and the support assembly configured to transition from a first configuration to a second configuration as the user moves from the first surface to the second surface.

4. The system of claim 1, wherein the support track has a third portion with a slope substantially equal to zero, the second portion of the support track disposed between the first portion and the third portion, the surface of the support track extending along the third portion allowing the drive wheel to move the trolley along the third portion of the support track when the user moves along a third surface separate from the second surface.

5. The system of claim 4, wherein the first portion of the support track is disposed at a first elevation associated with an elevation of the first surface and the third portion of the support track is disposed at a second elevation associated with an elevation of the second surface, the first elevation is different from the second elevation.

6. The system of claim 5, wherein the second surface is at least one of an incline, a decline, or a plurality of stairs.

7. The system of claim 1, wherein the gear is allowed to freely rotate as the drive wheel moves along the surface of the support track to move the trolley along the first portion of the support track.

8. A body weight support system, comprising:

a support track having a first portion, a second portion, and a third portion disposed between the first portion and the second portion, a slope of each of the first portion and the second portion being substantially equal to zero, a slope of the third portion being non-zero; and a trolley having a support assembly and a drive assembly, the support assembly configured to support at least a portion of a body weight of a user, the drive assembly configured to suspend the trolley from the support track, the drive assembly having a drive wheel in contact with and configured to move along a surface extending along each of the first portion, the second portion, and the third portion of the support track to move the trolley along the first portion of the support track when the user moves along a first surface, along the second portion of the support track when the user moves along a second surface separate from the first surface, and along the third portion of the support track as the user moves between the first surface and the second surface, the drive assembly having a gear configured to engage a set of protrusions formed by the surface along the third portion of the support track to increase an amount of traction as the drive wheel moves the trolley along the third portion of the support track, the surface along the first portion of the support track and the second portion of the support track being devoid of protrusions such that the gear is disengaged from the support track as the drive wheel moves the trolley along the first portion and along the second portion of the support track.

9. The system of claim 8, further comprising:

a power rail coupled to the support track, the power rail configured to be in electrical contact with a portion of the trolley as the trolley moves along the first portion of the support track, the second portion of the support track, and the third portion of the support track.

10. The system of claim 8, wherein the support assembly is configured to support a predetermined portion of the body weight of the user as the trolley moves along the first portion of the support track, the second portion of the support track, and the third portion of the support track.

11. The system of claim 8, wherein the first portion of the support track is disposed at a first elevation associated with an elevation of the first surface and the second portion of the support track is disposed at a second elevation associated with an elevation of the second surface, the first elevation is different from the second elevation.

12. The system of claim 8, wherein the first portion of the support track is disposed at a first elevation associated with an elevation of the first surface and the second portion of the support track is disposed at a second elevation associated with an elevation of the second surface, the first elevation is different from the second elevation, and the third portion of the support track is coupled between the first portion and the second portion.

13. The system of claim 8, wherein the gear is allowed to freely rotate as the drive wheel moves along the surface of the support track to move the trolley along the first portion of the support track and the second portion of the support track.

14. A method of using a body weight support system including at least a trolley and a support track having a surface extending along at least a first portion and a second portion of the support track, the trolley having a support assembly configured to support at least a portion of a body weight of a user and a drive assembly configured to movably suspend the trolley from the support track, the drive assembly including a drive wheel and a gear, the method comprising:

advancing the drive wheel along the surface of the support track to move the trolley along the first portion of the support track in response to the user moving along a first surface;

supporting a predetermined portion of the body weight of the user as the user moves along the first surface;

advancing the drive wheel along the surface of the support track to move the trolley along the second portion of the support track in response to the user moving along a second surface separate from the first surface;

supporting the predetermined portion of the body weight of the user as the user moves along the second surface; and adjusting the support assembly after advancing the trolley along the first portion of the support track and prior to advancing the trolley along the second portion of the support track, the adjusting of the support assembly being (1) in response to the drive wheel being advanced along the surface of the support track to move the trolley along a third portion of the support track disposed between the first portion and the second portion and (2) such that the support assembly supports the predetermined portion of the body weight of the user, the gear configured to engage a set of protrusions formed by the surface along the third portion of the support track to increase an amount of traction between the drive assembly and the support track as the drive wheel moves the trolley along the third portion, the surface along the first portion of the support track and the second portion of the support track being devoid of protrusions such that the gear is disengaged from the first portion and the second portion of the support track as the drive wheel moves the trolley along the first portion and the second portion of the support track, respectively.

15. The method of claim 14, wherein the first surface has a first elevation and the second surface has a second elevation different from the first elevation, the first portion of the support track being disposed a predetermined distance above the first surface, and the second portion of the support track being disposed the predetermined distance above the second surface.

16. The method of claim 15, wherein the third portion of the support track is coupled between the first portion and the second portion.

17. The method of claim 16, wherein a slope of each of the first portion and the second portion of the support track is substantially equal to zero, a slope of the third portion of the support track being non-zero.

18. The method of claim 14, wherein the gear is allowed to freely rotate as the drive wheel moves along the surface of the support track to move the trolley along the first portion of the support track and the second portion of the support track.

* * * * *